US011527351B2

(12) United States Patent
Sato et al.

(10) Patent No.: US 11,527,351 B2
(45) Date of Patent: Dec. 13, 2022

(54) SURFACE-MOUNT INDUCTOR

(71) Applicant: Murata Manufacturing Co., Ltd., Kyoto-fu (JP)

(72) Inventors: Kozo Sato, Nagaokakyo (JP); Mikiya Aoki, Nagaokakyo (JP); Hiroyuki Aoki, Nagaokakyo (JP); Kazuhisa Kitamura, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 717 days.

(21) Appl. No.: 16/536,223

(22) Filed: Aug. 8, 2019

(65) Prior Publication Data

US 2020/0152374 A1 May 14, 2020

(30) Foreign Application Priority Data

Nov. 8, 2018 (JP) ..... JP2018-210887

(51) Int. Cl.

| | |
|---|---|
| ***H01F 27/28*** | (2006.01) |
| ***H01F 27/29*** | (2006.01) |
| ***H01F 27/32*** | (2006.01) |
| ***H01F 41/04*** | (2006.01) |
| ***H01F 41/12*** | (2006.01) |

(Continued)

(52) U.S. Cl.

CPC ..... *H01F 27/292* (2013.01); *H01F 3/08* (2013.01); *H01F 17/04* (2013.01); *H01F 27/255* (2013.01); *H01F 27/2823* (2013.01); *H01F 27/327* (2013.01); *H01F 2017/048* (2013.01)

(58) Field of Classification Search

CPC .... H01F 27/2804; H01F 27/29; H01F 27/323; H01F 41/041; H01F 41/122; H01F 2027/2809

See application file for complete search history.

(56) References Cited

U.S. PATENT DOCUMENTS

2011/0005064 A1* 1/2011 Klesyk ..... H01F 27/027 29/605
2012/0274433 A1* 11/2012 Matsumoto ..... H01F 27/292 336/192

(Continued)

FOREIGN PATENT DOCUMENTS

| | | | |
|---|---|---|---|
| CN | 101859641 | A | 10/2010 |
| CN | 108735433 | A | 11/2018 |
| JP | 2007-165779 | A | 6/2007 |

*Primary Examiner* — Elvin G Enad
*Assistant Examiner* — Malcolm Barnes
(74) *Attorney, Agent, or Firm* — Studebaker & Brackett PC

(57) ABSTRACT

A surface-mount inductor includes an element assembly having a core, a coil, and a magnetic material; and a pair of external terminals on a mounting surface of the element assembly. The core has a base portion and a columnar portion on an upper surface of the base portion. The coil is disposed on the base portion, and has a wound portion on the columnar portion, and a pair of extended portions extended from the wound portion. The base portion has at least one ridge portion at which the upper surface and a side surface are in linear contact with each other. The pair of extended portions are each disposed such that a flat surface portion connected to a flat surface portion disposed at an inner side portion of a conductive wire located at an outer peripheral portion of the wound portion is close to the ridge portion.

17 Claims, 17 Drawing Sheets

(51) Int. Cl.

| | |
|---|---|
| ***H01F 27/255*** | (2006.01) |
| ***H01F 3/08*** | (2006.01) |
| ***H01F 17/04*** | (2006.01) |

(56) References Cited

U.S. PATENT DOCUMENTS

| | | | | |
|---|---|---|---|---|
| 2013/0186995 | A1* | 7/2013 | Yamaguchi | H01F 17/045 242/432.6 |
| 2014/0002227 | A1* | 1/2014 | Hsieh | H01F 5/00 336/200 |
| 2014/0218157 | A1* | 8/2014 | Liu | H01F 1/14741 336/192 |
| 2016/0247626 | A1* | 8/2016 | Kawarai | H01F 27/00 |
| 2017/0125158 | A1* | 5/2017 | Shoda | H01F 41/076 |
| 2018/0308629 | A1* | 10/2018 | Shinohara | H01F 27/2823 |
| 2019/0027287 | A1* | 1/2019 | Kudo | H01F 27/29 |
| 2019/0096568 | A1* | 3/2019 | Yoon | H01F 17/0013 |
| 2019/0295760 | A1* | 9/2019 | Xia | H01F 41/0206 |

* cited by examiner

SURFACE-MOUNT INDUCTOR

CROSS-REFERENCE TO RELATED APPLICATION

This application claims benefit of priority to Japanese Patent Application No. 2018-210887, filed Nov. 8, 2018, the entire content of which is incorporated herein by reference.

BACKGROUND

Technical Field

The present disclosure relates to a surface-mount inductor.

Background Art

Japanese Unexamined Patent Application Publication No. 2007-165779 proposes a coil-sealed-type magnetic component including a coil having a wound portion that is formed by winding a conductive wire in two stages in a state where both ends of the conductive wire are located on an outer periphery thereof and the two stages are connected to each other at an inner periphery thereof, and a pair of extended portions extended from the wound portion; terminal electrodes having engagement portions for connecting to the extended portions of the coil; and an element assembly that contains the coil and the engagement portions and that is obtained by pressure-molding a mixture of magnetic powder and a resin. In the coil-sealed-type magnetic component, the extended portions of the coil are connected to the terminal electrodes within the element assembly, and the terminal electrodes are extended from side surfaces of the element assembly, and the extended terminal electrodes are bent onto the bottom surface of the element assembly, and the coil-sealed-type magnetic component is used as a surface-mount inductor.

In the existing surface-mount inductor, the terminal electrodes to which the extended portions of the coil are connected are extended from the element assembly and bent to form external terminals. Thus, the number of components increases. In addition, excessive stress is applied to the element assembly during the processing, so that the stability of quality during production tends to decrease.

SUMMARY

Accordingly, one aspect of the present disclosure provides a surface-mount inductor having a structure with which the stability of quality during production is good.

According to preferred embodiments of the present disclosure, a surface-mount inductor includes an element assembly having a core including a base portion having a lower surface at a mounting surface side, an upper surface at a side opposite to the mounting surface, side surfaces adjacent to the upper surface and the lower surface, and a columnar portion disposed on the upper surface of the base portion. The core contains magnetic powder in at least a partial region. The element assembly also includes a coil disposed on the base portion. The coil has a wound portion formed by winding a conductive wire, having an insulating coating and having a pair of flat surface portions opposing each other, on the columnar portion in two upper and lower stages such that a surface of an inner peripheral portion of the wound portion is in contact with the columnar portion and the flat surface portions oppose each other in a state where both ends of the wound portion are located at an outer peripheral portion of the wound portion and the two stages are connected to each other at the inner peripheral portion of the wound portion. The coil also has a pair of extended portions extended from the wound portion toward the side surface of the base portion. The element assembly further includes a magnetic material formed to include the coil, cover at least a part of the core, and contain magnetic powder. The surface-mount inductor further includes a pair of external terminals disposed on the mounting surface of the element assembly and connected to the pair of extended portions, respectively. The base portion has at least one ridge portion at which the upper surface and the side surface are in linear contact with each other, and the pair of extended portions are each disposed such that the flat surface portion connected to the flat surface portion disposed at an inner side portion of the conductive wire located at the outer peripheral portion of the wound portion is close to the ridge portion.

According to preferred embodiments of the present disclosure, it is possible to provide a surface-mount inductor having a structure with which the stability of quality during production is good.

Other features, elements, characteristics and advantages of the present disclosure will become more apparent from the following detailed description of preferred embodiments of the present disclosure with reference to the attached drawings.

DETAILED DESCRIPTION

Figure 1:
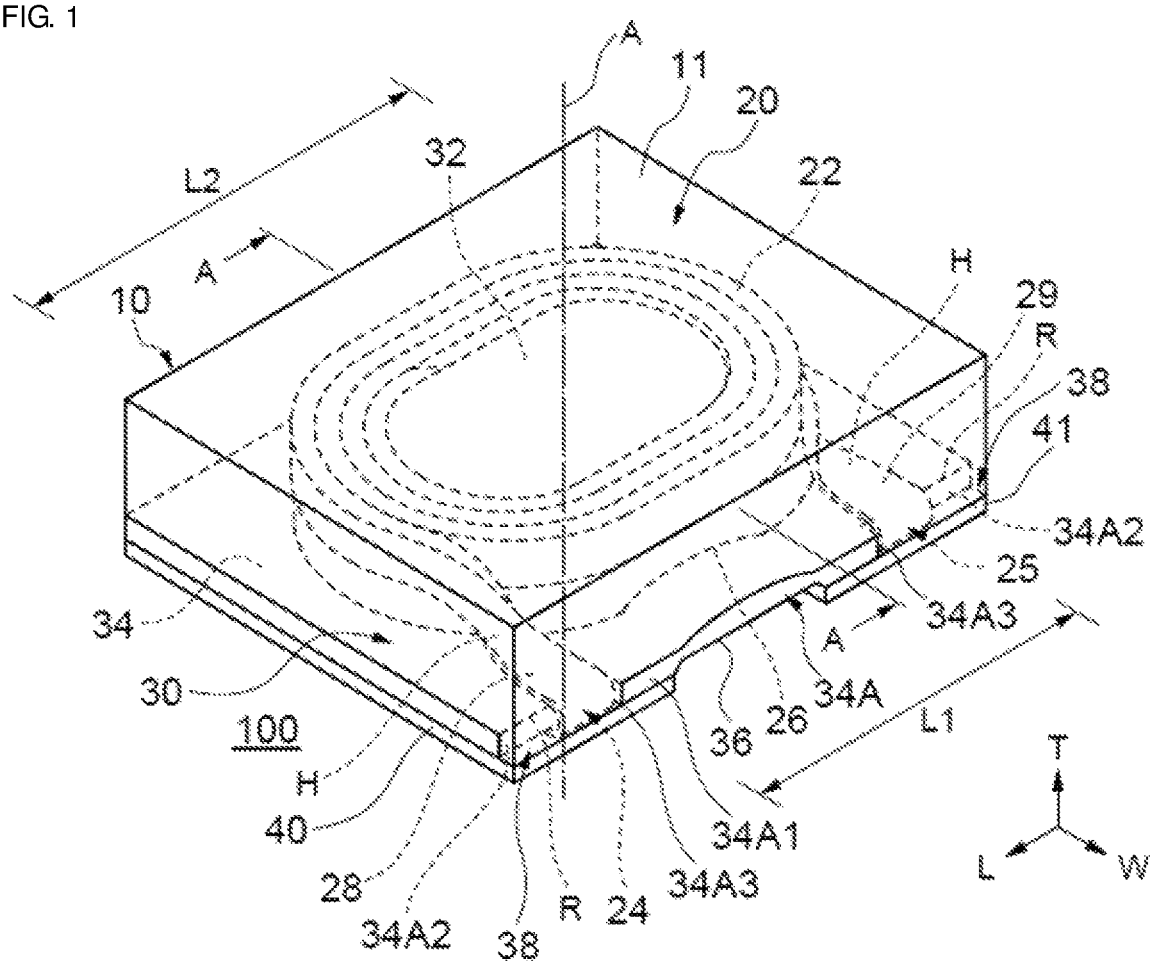
FIG. 1 is a partly transparent perspective view, as viewed from the upper surface side, showing a surface-mount inductor according to a first embodiment.

A surface-mount inductor includes an element assembly having a core, a coil, and a magnetic material; and a pair of external terminals. The core includes a base portion having a lower surface at a mounting surface side, an upper surface at a side opposite to the mounting surface, and side surfaces adjacent to the upper surface and the lower surface, and a columnar portion disposed on the upper surface of the base portion, and contains magnetic powder in at least a partial region. The coil is disposed on the base portion and has a wound portion formed by winding a conductive wire, having an insulating coating and having a pair of flat surface portions opposing each other, on the columnar portion in two upper and lower stages such that a surface of an inner peripheral portion of the wound portion is in contact with the columnar portion and the flat surface portions oppose each other in a state where both ends of the wound portion are located at an outer peripheral portion of the wound portion and the two stages are connected to each other at the inner peripheral portion of the wound portion, and a pair of extended portions extended from the wound portion toward the side surface of the base portion. The magnetic material is formed to include the coil, cover at least a part of the core, and contain at least magnetic powder. The element assembly is formed by the core, the coil, and the magnetic material. The pair of external terminals are disposed on the mounting surface of the element assembly and connected to the pair of extended portions, respectively. The base portion has at least one ridge portion at which the upper surface and the side surface are in linear contact with each other, and the pair of extended portions are each disposed such that the flat surface portion connected to the flat surface portion disposed at an inner side portion of the conductive wire located at the outer peripheral portion of the wound portion is close to the ridge portion.

Since the flat surface portion is close to the ridge portion, the position of the contact portion is stabilized. In addition, since each extended portion is extended such that the flat surface portion connected to the flat surface portion disposed at the inner side portion of the conductive wire located at the outer peripheral portion of the wound portion is close to the ridge portion, it is possible to inhibit excessive stress from being generated at a connection portion between the wound portion and the extended portion.

The pair of extended portions may be extended toward the same side surface and disposed close to the ridge portion, and a distance between positions at which the extended portions are in contact with the ridge portion may be larger than a distance between positions at which the wound portion is connected to the extended portions. It is possible to finely adjust the number of turns of the conductive wire in the wound portion, and it is possible to easily obtain desired inductance.

The pair of extended portions may be extended toward the same side surface and disposed close to the ridge portion, and a distance between positions at which the extended portions are in contact with the ridge portion may be smaller than a distance between positions at which the wound portion is connected to the extended portions. It is possible to finely adjust the number of turns of the conductive wire in the wound portion, and it is possible to easily obtain desired inductance.

The pair of extended portions may be extended toward the same side surface and disposed close to the ridge portion, the base portion may have another ridge portion opposing the ridge portion, and the columnar portion may be disposed closer to the ridge portion, to which the pair of extended portions are disposed close, than to the other ridge portion. It is possible to the element assembly having a thickness corresponding to the number of turns of the coil around the wound portion, and it is possible to easily adjust the balance of a magnetic flux within the element assembly. In addition, even when the size is reduced, it is possible to inhibit the wound portion of the coil from being exposed from the side surface of the element assembly.

The base portion may have a plurality of ridge portions at which the upper surface and the side surfaces are in linear contact with each other, and the pair of extended portions may be disposed close to different ridge portions. It is possible to adjust the number of turns of the conductive wire in the wound portion in a unit of ¼ turn by adjusting the position from which each extended portion is extended, and it is possible to easily obtain desired inductance.

The core may be disposed such that the lower surface of the base portion and an end surface of the columnar portion at a side opposite to the base portion are exposed from the element assembly. When the magnetic permeability of the core is higher than the magnetic permeability of the element assembly, the region in which the magnetic permeability is high is relatively increased, so that it is possible to improve the inductance value even with the same size.

The wound portion may be disposed such that a surface thereof at the side opposite to the mounting surface is exposed from the element assembly, and a resin layer that does not contain magnetic powder may be provided on the surface at the side opposite to the mounting surface. Since the layer that intersects a magnetic flux and that does not contain magnetic powder is provided, it is possible to improve direct current superposition characteristics.

The base portion may have a region that does not contain magnetic powder. Since the region that intersects a magnetic flux and that does not contain magnetic powder is provided, it is possible to improve direct current superposition characteristics.

The columnar portion may have a region that does not contain magnetic powder. Since the region that intersects a magnetic flux and that does not contain magnetic powder is provided, it is possible to improve direct current superposition characteristics.

The magnetic powder may include metallic magnetic powder, and a high-insulation region having higher insulation properties than the other surface may be located in the mounting surface. Since the high-insulation region is located in the mounting surface, it is possible to improve a dielectric breakdown voltage between the wound portion of the coil and each external terminal.

The two stages of the wound portion may have different numbers of turns, and the stage closer to the base portion may have a larger number of turns. Since the number of turns at the upper stage side of the wound portion that is not covered with the base portion is smaller, it is possible to improve the sealability of the wound portion by the element assembly.

As used herein, the term "process" not only includes an independent process but also includes a process that is not clearly distinguishable from another process, as long as the initial object of the process is achieved. Hereinafter, embodiments of the present disclosure will be described with reference to the drawings. It should be noted that the embodiments described below are intended to illustrate surface-mount inductors for embodying the technical idea of the present disclosure, and the present disclosure is not limited to the surface-mount inductors described below. Members recited in the claims are not limited to members of the embodiments at all. In particular, the scope of the present disclosure is not limited to dimensions, materials, shapes, relative arrangements, etc., of constituent parts described in the embodiments unless specifically described, and they are only explanatory examples. In each drawing, the same parts are designated by the same reference signs. Although the embodiments are separately described for convenience in consideration of the description of main points or ease of understanding, components described in different embodiments may be partially replaced or combined with each other. Description of points common to a first embodiment will be omitted and only the points different from the first embodiment will be described in second and subsequent embodiments. In particular, similar effects and advantages achieved by similar components are not duplicated in each embodiment.

EMBODIMENTS

First Embodiment

Figure 2:
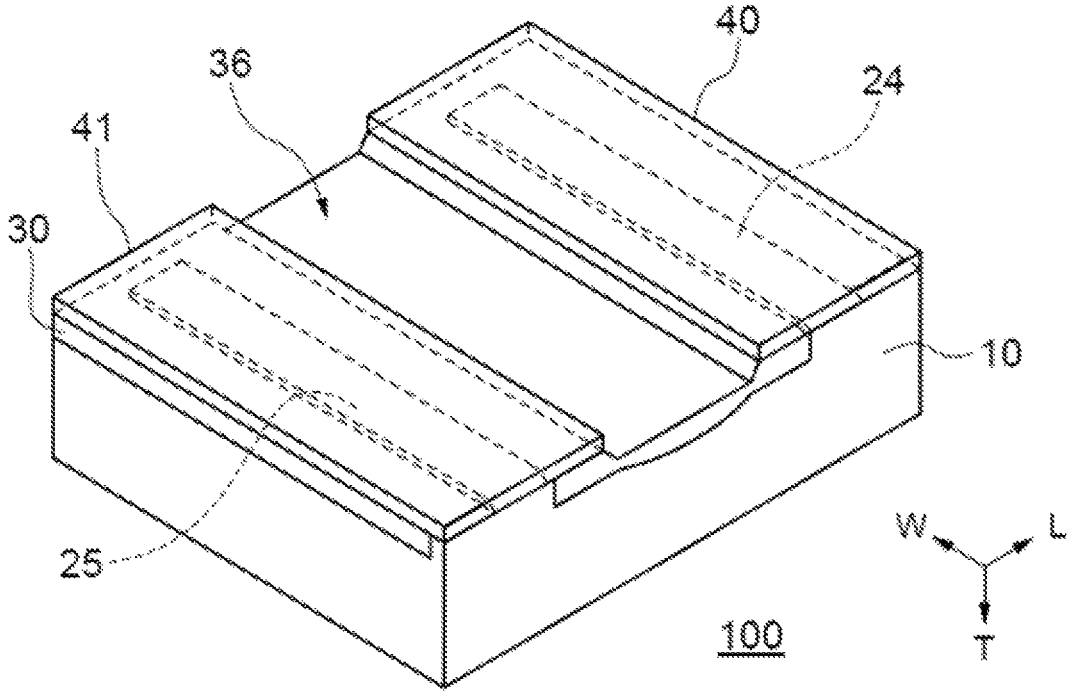
FIG. 2 is a partly transparent perspective view, as viewed from the mounting surface side, showing the surface-mount inductor according to the first embodiment.
Figure 3:
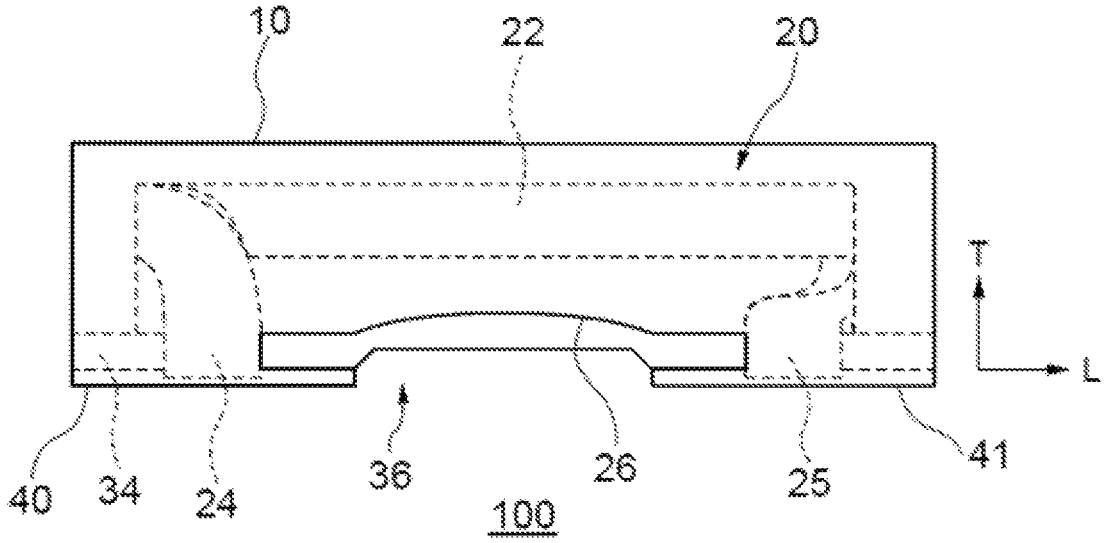
FIG. 3 is a partly transparent plan view, as viewed from the side surface, showing the surface-mount inductor according to the first embodiment.
Figure 4:
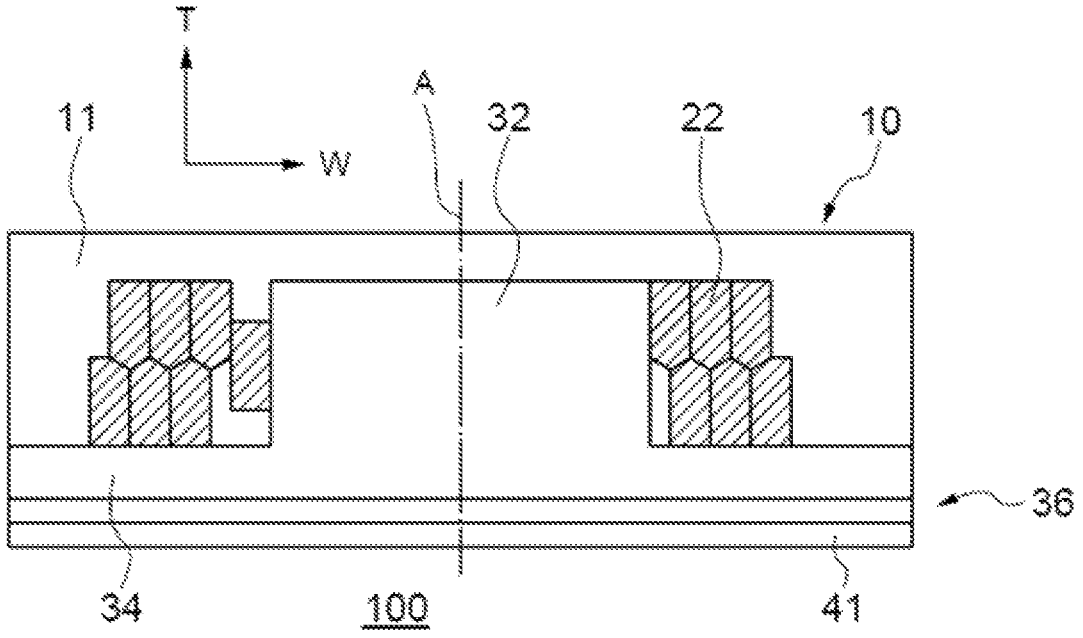
FIG. 4 is a schematic cross-sectional view taken along a cross-section passing through a line A-A in FIG. 1.
Figure 5A:
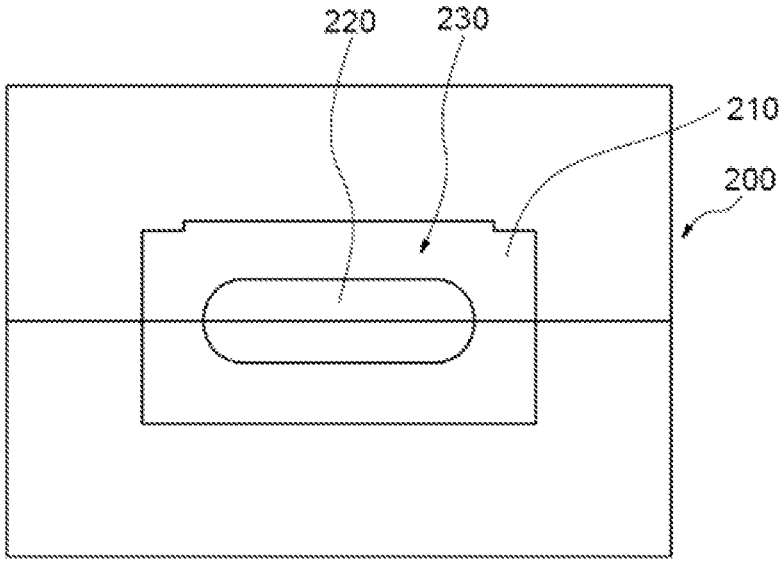
FIG. 5A is a schematic top view of a mold for forming a core of the surface-mount inductor according to the first embodiment.
Figure 5B:
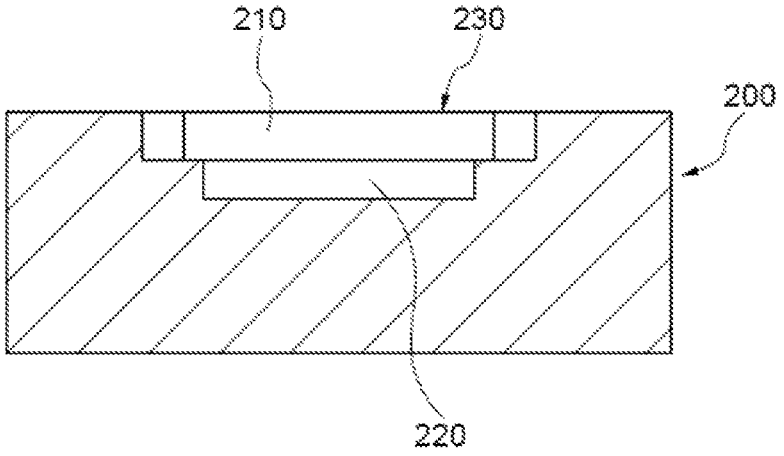
FIG. 5B is a schematic cross-sectional view of the mold.
Figure 6:
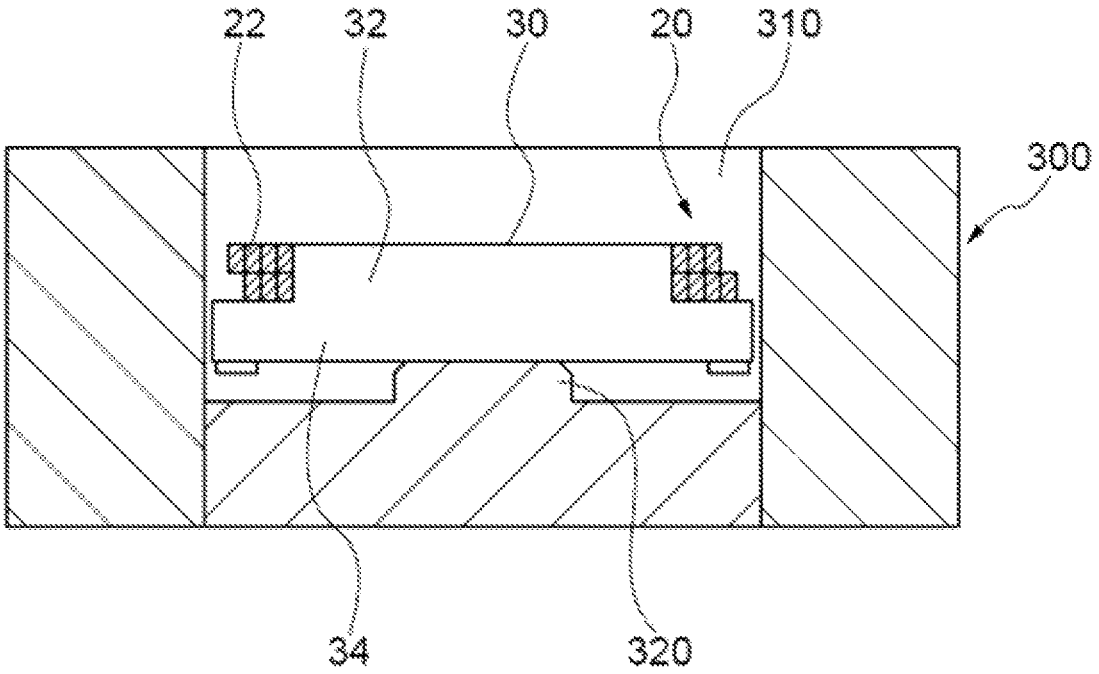
FIG. 6 is a schematic cross-sectional view for explaining a process for producing the surface-mount inductor according to the first embodiment.
Figure 7:
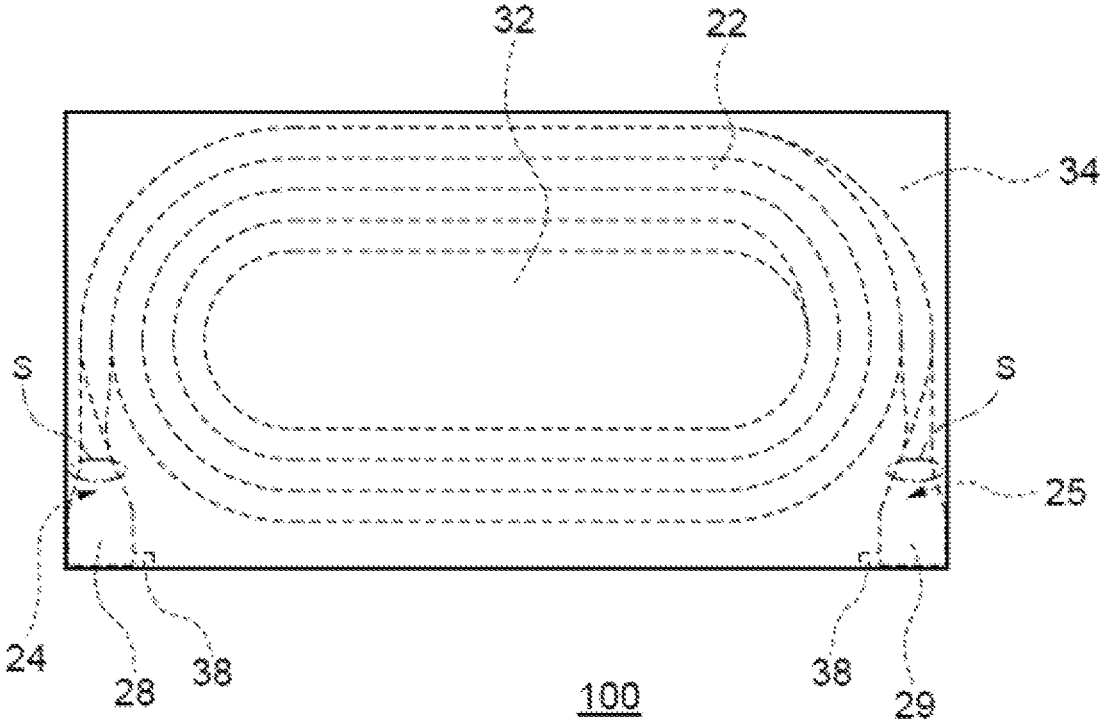
FIG. 7 is a schematic partly transparent plan view, as viewed from the upper surface side, for explaining different-shape portions of a pair of extended portions of the surface-mount inductor according to the first embodiment.
Figure 8:
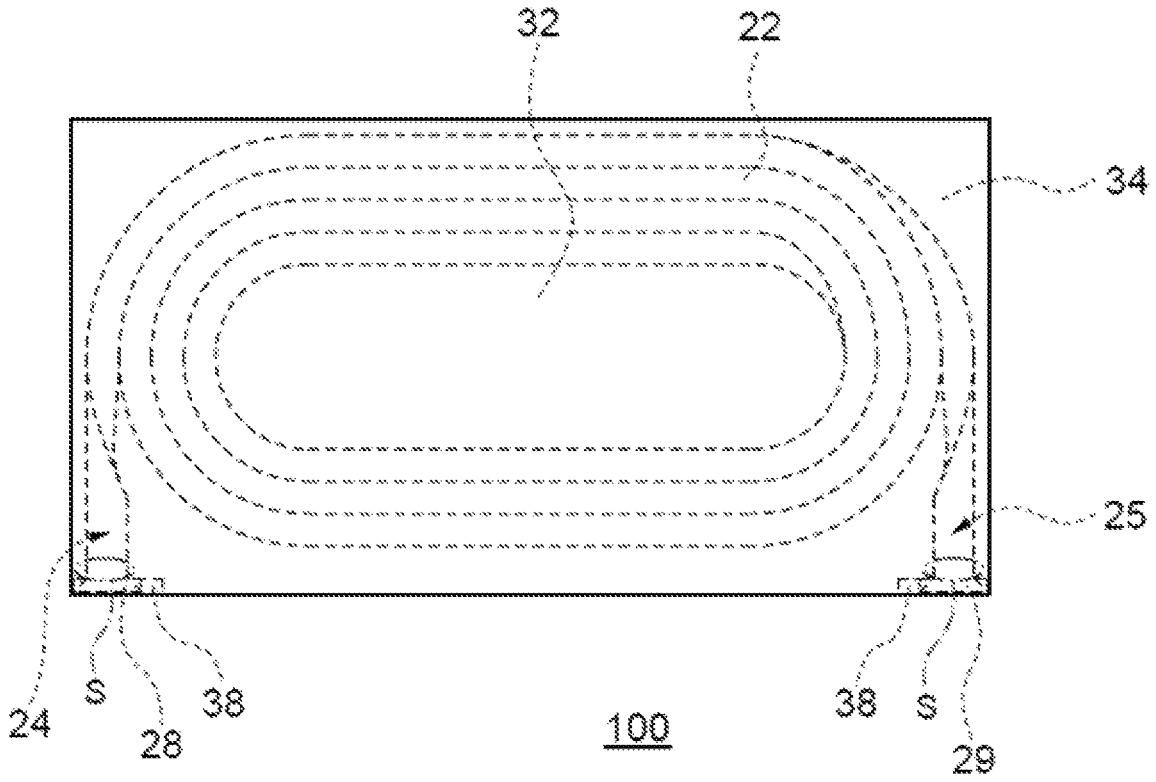
FIG. 8 is another schematic partly transparent plan view, as viewed from the upper surface side, for explaining the different-shape portions of the pair of extended portions of the surface-mount inductor according to the first embodiment.

A surface-mount inductor 100 according to a first embodiment will be described with reference to FIGS. 1 to 8. FIG. 1 is a schematic partly transparent perspective view of the surface-mount inductor 100 as viewed from an upper surface at the side opposite to a mounting surface, and FIG. 2 is a schematic partly transparent perspective view of the surface-mount inductor 100 as viewed from the mounting surface side. FIG. 3 is a partly transparent plan view of the surface-mount inductor 100 as viewed from the side surface. FIG. 4 is a schematic cross-sectional view of the surface-mount inductor 100 taken along a cross-section passing through a line A-A in FIG. 1. FIG. 5A is a top view of a mold for forming a core 30, and FIG. 5B is a cross-sectional view of the mold. FIG. 6 is a cross-sectional view for explaining a part of a process for producing the surface-mount inductor 100. FIGS. 7 and 8 are each a partly transparent plan view, as viewed from the upper surface side, for explaining different-shape portions 28 and 29 of a pair of extended portions 24 and 25.

As shown in FIG. 1, the surface-mount inductor 100 includes an element assembly 10 having the core 30, a coil 20, and a magnetic material 11; and a pair of external terminals 40 and 41. The core 30 includes a base portion 34 and a columnar portion 32. The coil 20 includes a wound portion 22 formed by winding a conductive wire about a winding axis A; and the pair of extended portions 24 and 25 extended from an outer peripheral portion of the wound portion 22. The magnetic material 11 covers the coil 20 and the core 30 and is formed to contain at least magnetic powder. The pair of external terminals 40 and 41 are disposed on the mounting surface of the element assembly 10 and electrically connected to the pair of extended portions 24 and 25, respectively. In the surface-mount inductor 100, the core 30, the coil 20, and the magnetic material 11 are integrally formed to form the element assembly 10. The surface-mount inductor 100 has a substantially rectangular parallelepiped shape that is defined with a height T in a direction substantially orthogonal to the mounting surface and with a length L and a width W substantially parallel to the mounting surface and substantially orthogonal to each other.

The base portion 34 of the core 30 has a lower surface at the mounting surface side, an upper surface at the side opposite to the mounting surface, and four side surfaces adjacent to the upper surface and the lower surface. In addition, the base portion 34 has four ridge portions at which the upper surface and the side surfaces are in contact with each other. The columnar portion 32 of the core 30 is disposed on the upper surface of the base portion 34 such that the extension direction thereof intersects the upper surface. A cross-sectional shape orthogonal to the extension direction of the columnar portion 32 is substantially an oval or an ellipse. A recess 36 is provided on the lower surface of the base portion 34 so as to intersect the extension direction of the columnar portion 32 and extend in the width W direction of the surface-mount inductor 100, and is formed as a standoff. A part of the upper surface of the base portion 34 is curved at the side opposite to the mounting surface side, so as to correspond to the recess 36. Two cut portions 38 for housing and allowing the extended portions 24 and 25 of the coil 20 to extend to the lower surface side are provided on one of the side surfaces intersecting the direction in which the recess 36 of the base portion 34 extends. The core 30 is formed from a composite material containing magnetic powder and a resin, by pressure-molding into a state where the base portion 34 and the columnar portion 32 are integrated with each other. The core 30 is formed such that the filling ratio of the magnetic powder is, for example, not less than about 60% by weight and preferably not less than about 80% by weight. As the magnetic powder, iron-based metallic magnetic powder such as Fe, Fe—Si—Cr, Fe—Ni—Al, Fe—Cr—Al, Fe—Si, Fe—Si-A, Fe—Ni, and Fe—Ni—Mo, other composition-based metallic magnetic powder, metallic magnetic powder such as amorphous, metallic magnetic powder whose surface is coated with an insulator such as glass, metallic magnetic powder whose surface is modified, and nano-level minute metallic magnetic powder are used. As the resin, thermosetting resins such as an epoxy resin, a polyimide resin, and a phenol resin, and thermoplastic resins such as a polyethylene resin and a polyamide resin are used.

For the coil 20, a conductive wire (a so-called rectangular wire) having an insulating coating and having a pair of flat surface portions opposing each other is used. The coil 20 has the wound portion 22 and the extended portions 24 and 25 extended from the outer peripheral portion of the wound portion 22, and is disposed on the base portion 34. The wound portion 22 is formed by winding the conductive wire on the columnar portion 32 in two upper and lower stages (in so-called alpha-winding) such that, in a state where both ends of the conductive wire are located at the outer peripheral portion and the two stages are connected to each other at an inner peripheral portion of the wound portion 22, the surface of the inner peripheral portion is in contact with the columnar portion 32, and the flat surface portions oppose each other. The extended portions 24 and 25 are continuously formed from both ends of the conductive wire, forming the wound portion 22, which are located on the outer peripheral portion thereof, and the extended portions 24 and 25 are extended toward the side surface of the base portion 34. A cross-section orthogonal to the length direction of the conductive wire has, for example, a substantially rectangular shape and is defined by the wire width of the flat surface portion corresponding to a long side of the rectangular and a thickness that is the distance, between the flat surface portions, corresponding to the short sides of the rectangular. The conductive wire is formed such that the wire width thereof is, for example, not less than about 120 μm and not greater than about 350 μm (i.e., from about 120 μm to about 350 μm) and the thickness thereof is, for example, not less than about 10 μm and not greater than about 150 μm (i.e., from about 10 μm to about 150 μm). In addition, the insulating coating of the conductive wire is formed from an insulating resin such as polyamide imide such that the thickness thereof is, for example, not less than about 2 μm and not greater than about 10 μm (i.e., from about 2 μm to about 10 μm) and is preferably about 6 μm. A self-fusing layer containing a self-fusing component such as a thermoplastic resin or a thermosetting resin is further provided on the surface of the insulating coating and formed such that the thickness thereof is not less than about 1 μm and not greater than about 3 μm (i.e., from about 1 μm to about 3 μm).

The wound portion 22 is formed such that the surface of the inner peripheral portion thereof is in contact with the surface of the columnar portion 32 of the core 30. In addition, regarding the winding direction of the wound portion 22, the wound portion 22 is wound clockwise from the extended portion 24 toward the extended portion 25 as viewed from the upper surface side. A curved portion 26 that projects at the upper surface side of the wound portion 22 is formed on the lower surface of the wound portion 22 that is in contact with the base portion 34 of the core 30. That is, the curved portion 26 is curved at the side opposite to the base portion 34 side of the core 30. In FIG. 1, only the lower surface of the lower stage of the wound portion 22 in which the conductive wire is wound in the two upper and lower stages has a curved portion. However, a curved portion may be formed such that the lower surface of the lower stage and the upper surface of the lower stage are curved. Furthermore, a curved portion may be formed such that the lower surface of the lower stage, the upper surface of the lower stage, and the lower surface of the upper stage are curved, or a curved portion may be further formed such that the lower surface of the lower stage, the upper surface of the lower stage, the lower surface of the upper stage, and the upper surface of the upper stage are curved. Moreover, as shown in FIG. 4, in at least a part of a region where the upper stage and the lower stage of the wound portion 22 are in contact with or oppose each other, a meandering surface at which the conductive wire at the upper stage side and the conductive wire at the lower stage side are arranged so as to be mutually nested is present. FIG. 4 is a schematic cross-sectional view of the surface-mount inductor 100 in FIG. 1 taken along a plane passing through a line A-A and parallel to the winding axis A of the wound portion 22. That is, on a cross-section parallel to the winding axis A, in at least a part of the region where the upper stage and the lower stage are in contact with or oppose each other, the wound portion 22 has a boundary surface formed by the conductive wire at one of the upper stage side and the lower stage side being in contact with or opposing a plurality of portions of the conductive wire at the other side. In addition, the boundary surface may be formed on a part of any cross-section other than the cross-section parallel to the winding axis A and passing through the line A-A, and, for example, may be formed on a part in the circumferential direction of the wound portion 22 or in a direction away from the winding axis A.

The pair of extended portions 24 and 25 of the coil 20 are each extended from the outer periphery of the wound portion 22 toward a side surface 34A of the base portion 34 on which the two cut portions 38 are provided. Since the two cut portions 38 are provided on the side surface 34A, the side surface 34A has a projecting portion 34A1, recessed portions 34A2, and portions 34A3 connecting the projecting portion 34A1 and the recessed portions 34A2. The surface of the projecting portion 34A1, the surfaces of the recessed portions 34A2, and the surfaces of the portions 34A3 connecting the projecting portion 34A1 and the recessed portions 34A2 form one side surface, and a ridge portion at which the upper surface of the base portion 34 and the surface of the projecting portion 34A1 are in contact with each other, ridge portions at which the upper surface of the base portion 34 and the surface of the recessed portions 34A2 are in contact with each other, and ridge portions at which the upper surface of the base portion 34 and the surface of the portions 34A3 connecting the projecting portion 34A1 and the recessed portions 34A2 are in contact with each other form one ridge portion R. In this case, the pair of extended portions 24 and 25 have an angle difference of about 90 degrees or less between the extended direction of the extended portion 24 and the extended direction of the extended portion 25 with the winding axis A as an origin.

Of the pair of extended portions 24 and 25, the extended portion 24 is extended from the upper stage of the wound portion 22, and the extended portion 25 is extended from the lower stage of the wound portion 22. The extended portion 24 is extended from the portion connected to the wound portion 22 toward the ridge portion R of the base portion 34 so as to be twisted by about 90° counterclockwise as viewed from the wound portion side. The extended portion 25 is extended from the portion connected to the wound portion 22 toward the ridge portion R of the base portion 34 so as to be twisted by about 90° clockwise as viewed from the wound portion side. That is, the pair of extended portions 24 and 25 are each disposed such that one of flat surface portions H of the conductive wire is close to the ridge portion R of the base portion 34. In FIG. 1, the pair of extended portions 24 and 25 are each disposed such that the flat surface portion connected to the flat surface portion of the conductive wire that is in contact with the columnar portion 32, that is, to the flat surface portion disposed at an inner side portion of the conductive wire located at the outer peripheral portion of the wound portion 22, is close to the ridge portion R of the base portion 34. Since each extended portion is disposed such that the flat surface portion connected to the flat surface portion disposed at the inner side portion of the conductive wire located at the outer peripheral portion R of the wound portion 22 is close to the ridge portion R of the base portion 34, each extended portion is twisted toward the center of the side surface of the base portion 34, a force in a winding-up direction along the winding direction of the wound portion 22 is applied between a connection portion between the wound portion 22 and one of the extended portions and a connection portion between the wound portion 22 and the other extended portion, and thus winding blister of the wound portion 22 is inhibited. In addition, in FIG. 1, the distance between the centers of the pair of extended portions 24 and 25 is set so as to be uniform regardless of the distance from the wound portion 22. That is, the pair of extended portions 24 and 25 are extended such that a distance L1 between the centers in the wire width direction at the positions of contact with the ridge portion R of the base portion 34 is substantially equal to a distance L2 between the centers in the thickness direction at the positions at which the wound portion 22 is connected to the extended portions 24 and 25. Furthermore, as shown in FIGS. 1, 2, and 3, the pair of extended portions 24 and 25 are housed in the cut portions 38 provided to the base portion 34, turn back, and extend to the mounting surface side of the base portion 34. Moreover, the pair of extended portions 24 and 25 may each be formed such that the wire width and the thickness thereof are substantially equal to the wire width and the thickness of the conductive wire 22 of the wound portion, or may each be formed such that at least either one of the wire width and the thickness thereof is different from that of the conductive wire of the wound portion 22. In FIG. 1, the different-shape portions 28 and 29 are formed so as to be wider than the wire width of the conductive wire of the wound portion 22 and be thinner than the thickness of the conductive wire of the wound portion 22. The different-shape portions 28 and 29 are each disposed such that a surface thereof connected to one of the flat surface portions H of the conductive wire is close to the ridge portion R of the base portion 34. The different-shape portions 28 and 29 are each formed such that, at the position close to the ridge portion R of the base portion 34, the wire width thereof is, for example, not less than about 1.4 times of the wire width of the conductive wire of the wound portion 22, for example, not less than about 168 μm and not greater than about 490 μm (i.e., from about 168 μm to about 490 μm), and the thickness thereof is, for example, about 50% of the thickness of the conductive wire of the wound portion 22, for example, not less than about 5 μm and not greater than about 75 μm (i.e., from about 5 μm to about 75 μm). Since the different-shape portions 28 and 29 are formed at the end portions of the extended portions 24 and 25, the thicknesses thereof are smaller than the thickness of the conductive wire of the wound portion, and thus the extended portions 24 and 25 are more easily bent to the mounting surface side so as to be close to the ridge portion R of the base portion 34. In addition, since the wire widths of the different-shape portions 28 and 29 are larger than the wire width of the conductive wire of the wound portion 22, it is possible to lengthen the portion of contact with the ridge portion R of the base portion 34 and stabilize the bending position, and it is also possible to further improve the reliability of connection with the external terminals.

The magnetic material 11 is formed so as to cover the coil 20, the columnar portion 32 of the core 30, and at least the upper surface of the base portion 34 of the core 30. In this case, the magnetic material 11 also covers the extended portions 24 and 25 and the cut portions 38 of the base portion 34. The magnetic material 11 is formed by pressure-molding a composite material containing magnetic powder and a resin. The filling ratio of the magnetic powder in the composite material is, for example, not less than about 60% by weight and preferably not less than about 80% by weight (i.e., from about 60% by weight to about 80% by weight). As the magnetic powder, iron-based metallic magnetic powder such as Fe, Fe—Si—Cr, Fe—Ni—Al, Fe—Cr—Al, Fe—Si, Fe—Si-A, Fe—Ni, and Fe—Ni—Mo, other composition-based metallic magnetic powder, metallic magnetic powder such as amorphous, metallic magnetic powder whose surface is coated with an insulator such as glass, metallic magnetic powder whose surface is modified, and nano-level minute metallic magnetic powder are used. As the resin, thermosetting resins such as an epoxy resin, a polyimide resin, and a phenol resin, and thermoplastic resins such as a polyethylene resin and a polyamide resin are used. Materials having the same composition may be used as the composite material for forming the magnetic material 11 and the composite material for forming the core 30. In addition, the filling ratio of the magnetic powder of the magnetic material 11 may be lower than the filling ratio of the magnetic powder in the core 30. The element assembly 10 is formed by the coil 20, the core 30, and the magnetic material 11.

As shown in FIG. 2, at the mounting surface side of the surface-mount inductor 100, the recess 36 is formed at a position corresponding to the curved portion 26 formed on the lower surface of the wound portion 22 of the coil 20, so as to penetrate in the width W direction, and serves as a standoff. In the regions at both sides of the recess 36, the pair of extended portions 24 and 25 of the coil 20 are disposed, respectively, and the pair of external terminals 40 and 41 connected to the pair of extended portions 24 and 25, respectively, are disposed. Furthermore, an exterior resin (not shown) is formed on the surface of the element assembly 10 other than the regions in which the external terminals 40 and 41 are disposed. The exterior resin contains a thermosetting resin such as an epoxy resin, a polyimide resin, and a phenol resin, or a thermoplastic resin such as a polyethylene resin and a polyamide resin, and may further contain a filler including silicon, titanium, etc.

The external terminals 40 and 41 are disposed so as to cover the extended portions 24 and 25, respectively, which are disposed at the mounting surface side. Each of the external terminals 40 and 41 is formed, for example, by plating, and includes a first layer formed from nickel and a second layer that is formed on the first layer and that is formed from tin. The external terminals 40 and 41 are formed on the entire regions at both sides of the recess 36 in FIG. 2, but may be formed so as to be smaller than the regions at both sides of the recess 36. In this case, the surfaces of the external terminals 40 and 41 are formed so as to be flush with the surface of the exterior resin formed on the mounting surface of the element assembly 10. In addition, in this case, the side surfaces, of the external terminals 40 and 41, which are in contact with the exterior resin, may be formed so as to extend onto the exterior resin formed on the mounting surface of the element assembly 10.

FIG. 3 is a partly transparent plan view of the surface-mount inductor 100 as viewed from the side surface direction at the side at which the extended portions 24 and 25 are extended. As shown in FIG. 3, the base portion 34 is partially exposed from the side surface of the surface-mount inductor 100, and the extended portions 24 and 25 are covered with the magnetic material 11. The extended portion 24 is extended from the upper stage of the wound portion 22, is bent such that the flat surface portion of the conductive wire that is at the inner side at the outer peripheral portion of the wound portion 22 is in contact with the base portion 34, and is disposed so as to extend on the lower surface of the base portion 34. The extended portion 25 is extended from the lower stage of the wound portion 22, is bent such that the flat surface portion of the conductive wire that is at the inner side at the outer peripheral portion of the wound portion 22 is in contact with the base portion 34, and is disposed so as to extend on the lower surface of the base portion 34. The external terminals 40 and 41 are disposed on the extended portions 24 and 25, respectively, which extend on the lower surface of the base portion 34. The recess 36 is formed at the mounting surface side of the surface-mount inductor 100, and the curved portion 26 is formed at the position corresponding to the lower surface of the wound portion 22. Since the wound portion 22 has the curved portion 26, even though the recess 36 is formed, it is possible to exhibit good magnetic characteristics, since the base portion 34 containing the magnetic powder is disposed with a sufficient thickness at the lower surface side of the wound portion 22.

In the surface-mount inductor 100 in FIG. 1, the cross-sectional shape orthogonal to the extension direction of the columnar portion 32 is substantially an oval or an ellipse, but may be substantially a circle, a rectangle, a polygon, or the like. In FIG. 1, the shape of the cross-section orthogonal to the length direction of the conductive wire is the shape of a substantially rectangular flat wire, but each side surface in the thickness direction may be curved such as substantially semicircular or semielliptical, not linear.

Next, an example of a method for producing the surface-mount inductor 100 will be described. The method for producing the surface-mount inductor 100 includes, for example, a core forming step, a coil forming step, a different-shape portion forming step, an extended portion disposing step, a molding/curing step, an exterior resin forming step, an exterior resin removing step, and an external terminal forming step.

Core Forming Step

A composite material containing magnetic powder and a resin is loaded into the cavity of a mold capable of forming a columnar portion and a base portion. The mold 200 includes, for example, a cavity 230 having a first portion 210 having a shape and a depth for forming the base portion; and a second portion 220 that is provided on the bottom surface of the first portion 210 and that has a shape and a depth for forming the columnar portion, as shown in FIGS. 5A and 5B. In a state where the composite material is heated within the mold to a temperature equal to or higher than the softening temperature of the resin (for example, not lower than 60° C. and not higher than 150° C.), a pressure of not lower than about 1 t/cm$^2$ and not higher than about 10 t/cm$^2$ is applied thereto for several seconds to several minutes to mold a core. Next, the core is heated to a temperature equal to or higher than the curing temperature of the resin (for example, not lower than 100° C. and not higher than 220° C.) to be cured to obtain a core that has a flat plate-shaped base portion and a columnar portion disposed on the base portion and that has two cut portions on one of four side surfaces of the base portion. The resin may not be fully cured and may be semi-cured. In such a case, the resin may be semi-cured into a desired state by adjusting the temperature (for example, not lower than 100° C. and not higher than 220° C.) and the curing time (for example, not shorter than 1 minute and not longer than 60 minutes).

Coil Forming Step

A coil having a wound portion and a pair of extended portions extended from the wound portion is formed by winding a conductive wire on the columnar portion of the obtained core. As the conductive wire, a flat wire having an insulating coating and having a substantially rectangular cross-section is used. The wound portion is formed by winding the conductive wire in two stages such that both ends of the conductive wire are located at the outer periphery thereof and the two stages are connected to each other at the inner periphery thereof. In addition, the wound portion is formed by winding the flat wire on the columnar portion such that the width direction of the flat wire is substantially parallel to the extension direction of the columnar portion and one of flat surface portions of the flat wire opposes the columnar portion. Accordingly, the core in which the coil is mounted is obtained.

Different-Shape Portion Forming Step

A different-shape portion that is wider than the wire width of the conductive wire of the wound portion and that is thinner than the thickness of the conductive wire is formed at an end portion of each of the pair of extended portions of the coil by crushing the end portion.

Extended Portion Disposing Step

Each of the pair of extended portions of the coil is extended toward the side surface, of the base portion of the core, on which the two cut portions are formed, and is disposed such that one of the flat surface portions of the conductive wire is close to a ridge portion of the base portion. The pair of extended portions are extended from the upper surface of the base portion of the core toward a side surface of the base portion so as to be twisted in directions different from each other. In the surface-mount inductor 100, the pair of extended portions are each extended so as to be twisted such that the flat surface portion located at the inner side at the outer peripheral portion of the wound portion of the coil is close to the ridge portion of the base portion. The distance between the centers of the pair of extended portions is set so as to be substantially uniform regardless of the distance from the wound portion. The pair of extended portions are bent to the mounting surface side of the core via the cut portions, which are provided to the base portion of the core, and are disposed on the lower surface of the core.

Molding/Curing Step

As shown in FIG. 6, the core 30 in which the coil 20 is mounted is put in a cavity 310 of a mold 300 having a projection 320 on a bottom surface thereof, such that the lower surface of the base portion 34 opposes the bottom surface of the cavity 310 of the mold 300, and the lower surface of the base portion 34 is brought into contact with the bottom surface of the cavity 310 of the mold 300. A composite material containing magnetic powder and a resin is loaded into the cavity 310 of the mold 300 in which the core in which the coil is mounted is put. In a state where the composite material is heated within the mold 300 to a temperature not lower than the softening temperature of the resin (for example, not lower than 60° C. and not higher than 150° C.), a pressure of not lower than 100 kg/cm$^2$ and not higher than 500 kg/cm$^2$ is applied to the composite material, and the composite material is further heated to a temperature equal to or higher than the curing temperature of the resin (for example, not lower than 100° C. and not higher than 220° C.) to be molded and cured, whereby the coil and the core are covered with the magnetic material, and an element assembly is formed by the coil, the core, and the magnetic material. Curing may be carried out after molding.

As a result of the molding/curing step, a recess (standoff) is formed on the mounting surface of the element assembly, and a curved portion is formed on the lower surface of the base portion and the mounting surface side of the wound portion of the coil so as to correspond to the recess.

When pressing, molding, and curing the composite material that is loaded into the mold and that contains the magnetic powder and the resin, in a state where the composite material is heated to a temperature not lower than the softening temperatures of the resin of the composite material and the insulating coating and the self-fusing layer of the conductive wire (for example, not lower than 60° C. and not higher than 150° C.), the composite material is pressed under a pressure of not lower than 100 kg/cm$^2$ and not higher than 500 kg/cm$^2$, and heated to a temperature equal to or higher than the curing temperature of the resin of the composite material (for example, not lower than 100° C. and not higher than 220° C.) to be molded and cured, whereby the boundary surface between the upper stage and the lower stage of the wound portion of the coil is formed by a meandering surface at which the upper stage and the lower stage are arranged so as to be mutually nested. The meandering surface may be formed in a part of a region where the upper stage and the lower stage of the wound portion of the coil are in contact with or oppose each other.

Exterior Resin Forming Step

Next, an exterior resin is formed on the entire surface of the obtained element assembly. The exterior resin is formed by providing a thermosetting resin such as epoxy resin, a polyimide resin, and a phenol resin, or a thermoplastic resin such as a polyethylene resin and a polyamide resin to the surface by a means such as application, and dip; and curing the resin.

Exterior Resin Removing Step

The insulating coating of the conductive wire and the exterior resin at the positions at which external terminals are to be formed are removed from the element assembly on which the exterior resin is formed. The removal of the exterior resin and the insulating coating is carried out by using a physical means such as laser, blast processing, and polishing.

External Terminal Forming Step

The external terminals are formed by plating at the portions where the exterior resin is removed. The external terminals are formed by causing plating growth on the magnetic powder exposed on the surface and the extended portions 24 and 25 of the coil. As a result of the plating growth, for example, a first layer formed from nickel is formed, and then a second layer formed from tin is formed on the first layer.

FIG. 7 is a schematic partly transparent plan view, as viewed from the upper surface side, for explaining the different-shape portions of the pair of extended portions 24 and 25 of the surface-mount inductor 100 according to the first embodiment. In FIG. 7, the different-shape portions 28 and 29 that are wider than the wire width of the conductive wire and that are thinner than the thickness of the conductive wire are formed at the end portions of the pair of extended portions 24 and 25, are bent at the positions of the cut portions of the base portion 34 from the middle of the different-shape portions 28 and 29, and extend to the mounting surface side of the base portion 34. Roots S from which the different-shape portions 28 and 29 are formed extend between the side surfaces and the wound portion of the coil at the upper surface side of the base portion 34.

FIG. 8 is a schematic partly transparent plan view, as viewed from the upper surface side, for explaining another example of arrangement of the different-shape portions of the pair of extended portions 24 and 25 of the surface-mount inductor 100 according to the first embodiment. In FIG. 8, the different-shape portions 28 and 29 that are wider than the wire width of the conductive wire and that are thinner than the thickness of the conductive wire are formed at the end portions of the pair of extended portions 24 and 25, are bent at the roots S from which the different-shape portions 28 and 29 are formed, that is, at the cut portions of the base portion 34, and extend to the mounting surface side of the base portion 34. Since the different-shape portions are bent at the roots S thereof, the extended portions 24 and 25 are easily bent at the positions at which the wire width and the thickness of the conductive wire are different, and stress when bending is reduced. Thus, it is possible to reduce the thickness of the base portion. Accordingly, it is possible to make the thicknesses of upper and lower magnetic paths of the wound portion equal to each other, a more uniform magnetic flux is obtained, and good magnetic characteristics are obtained.

Second Embodiment

Figure 9:
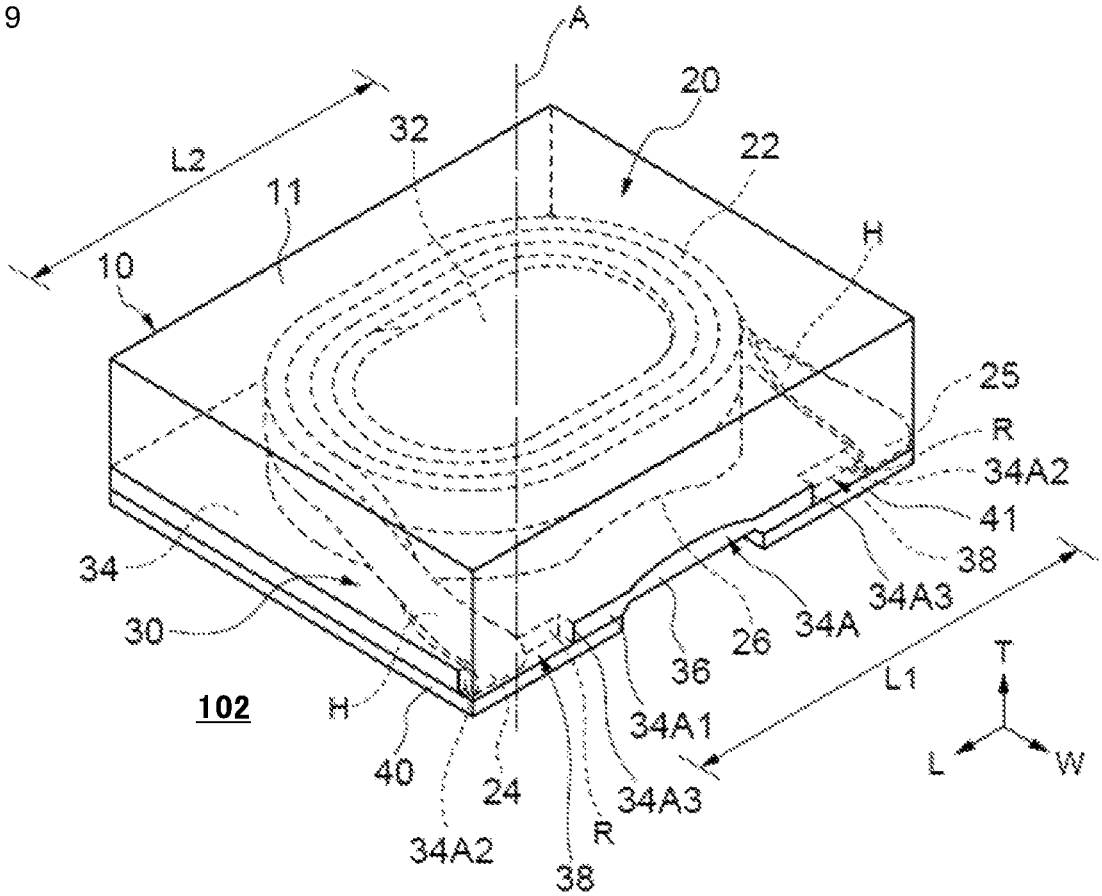
FIG. 9 is a partly transparent perspective view, as viewed from the upper surface side, showing a surface-mount inductor according to a second embodiment.

A surface-mount inductor 102 according to a second embodiment will be described with reference to FIG. 9. FIG. 9 is a schematic partly transparent perspective view, as viewed from the upper surface side, showing the surface-mount inductor 102. The surface-mount inductor 102 is configured in the same manner as the surface-mount inductor 100, except that the extended portions 24 and 25 are disposed such that the interval L1 between the contact positions at which the pair of extended portions 24 and 25 are in contact with the ridge portion R of the base portion 34 is larger than the interval L2 between the positions at which the wound portion 22 is connected to the extended portions 24 and 25. The interval L1 between the contact positions is the distance between the centers in the wire width direction of the pair of extended portions 24 and 25 at the ridge portion R of the base portion 34, and the interval L2 between the positions at which the wound portion 22 is connected to the extended portions 24 and 25 is the distance between the centers in the thickness direction of the conductive wire at the positions at which the wound portion 22 is connected to the extended portions 24 and 25.

In the surface-mount inductor 102, similar to the surface-mount inductor 100, the pair of extended portions 24 and 25 are extended from the outer periphery of the wound portion 22 toward the side surface 34A on which the two cut portions 38 of the base portion 34 are provided, but the pair of extended portions 24 and 25 are disposed so as to be extended such that the distance L1 between the centers in the wire width direction of the pair of extended portions 24 and 25 increases from the end portion of the wound portion 22, which is a connection portion between the wound portion 22 and each extended portion, toward the ridge portion R of the base portion 34, in accordance with the distance from the wound portion 22. Accordingly, it is possible to finely adjust the number of turns of the wound portion 22, so that it is possible to adjust the inductance value to a smaller value.

Figure 10:
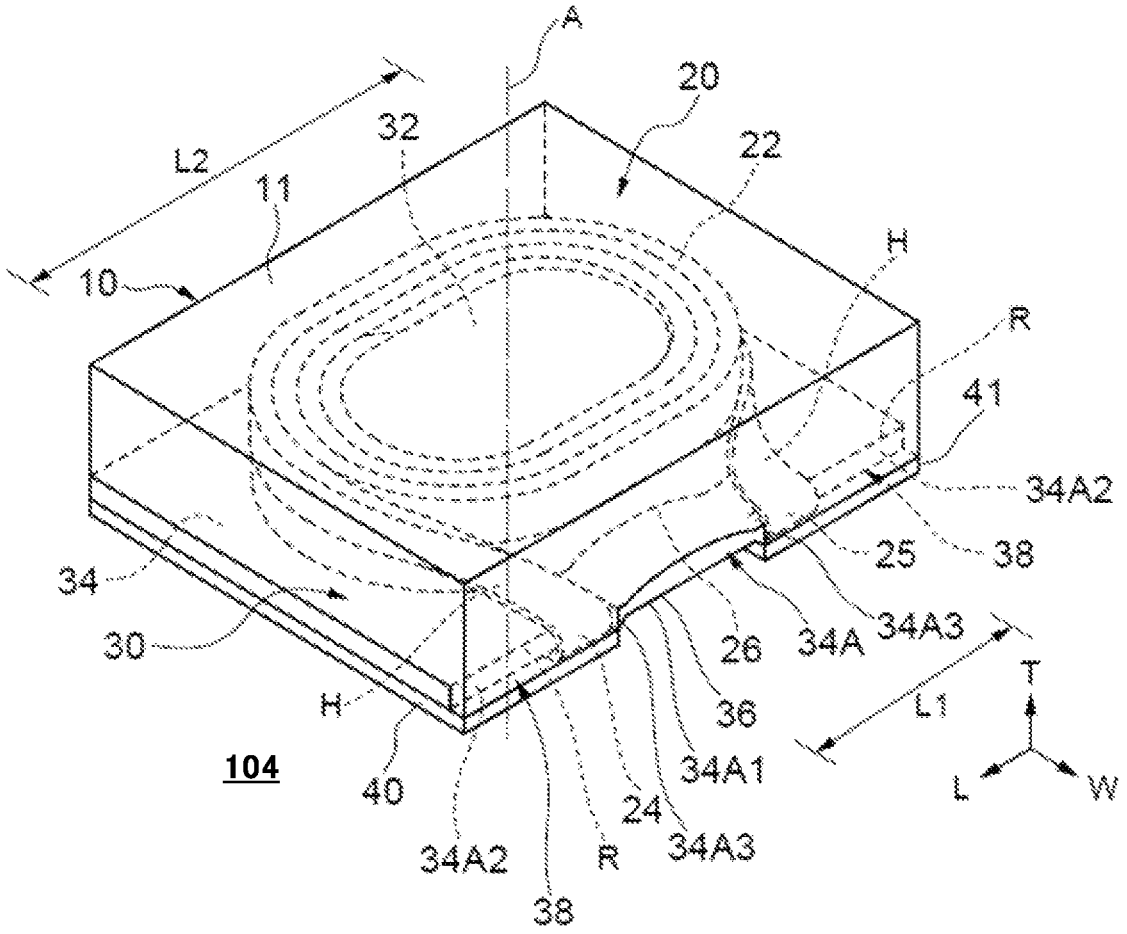
FIG. 10 is a partly transparent perspective view, as viewed from the upper surface side, showing a modification of the surface-mount inductor according to the second embodiment.

FIG. 10 is a partly transparent perspective view, as viewed from the upper surface side, showing a surface-mount inductor 104 that is a modification of the second embodiment. The surface-mount inductor 104 is configured in the same manner as the surface-mount inductor 100, except that the extended portions 24 and 25 are disposed such that the interval L1 between the contact positions at which the pair of extended portions 24 and 25 are in contact with the ridge portion R of the base portion 34 is smaller than the interval L2 between the positions at which the wound portion 22 is connected to the extended portions. In the surface-mount inductor 104, similar to the surface-mount inductor 100, the pair of extended portions 24 and 25 are extended from the outer periphery of the wound portion 22 toward the side surface 34A on which the two cut portions 38 of the base portion 34 are provided, but the pair of extended portions 24 and 25 are disposed so as to be extended such that the distance L1 between the centers in the wire width direction of the pair of extended portions 24 and 25 decreases from the end portion of the wound portion 22, which is a connection portion between the wound portion 22 and each extended portion, toward the ridge portion R of the base portion 34, in accordance with the distance from the wound portion 22. Accordingly, it is possible to finely adjust the number of turns of the wound portion 22, so that it is possible to adjust the inductance value to a higher value.

Third Embodiment

Figure 11:
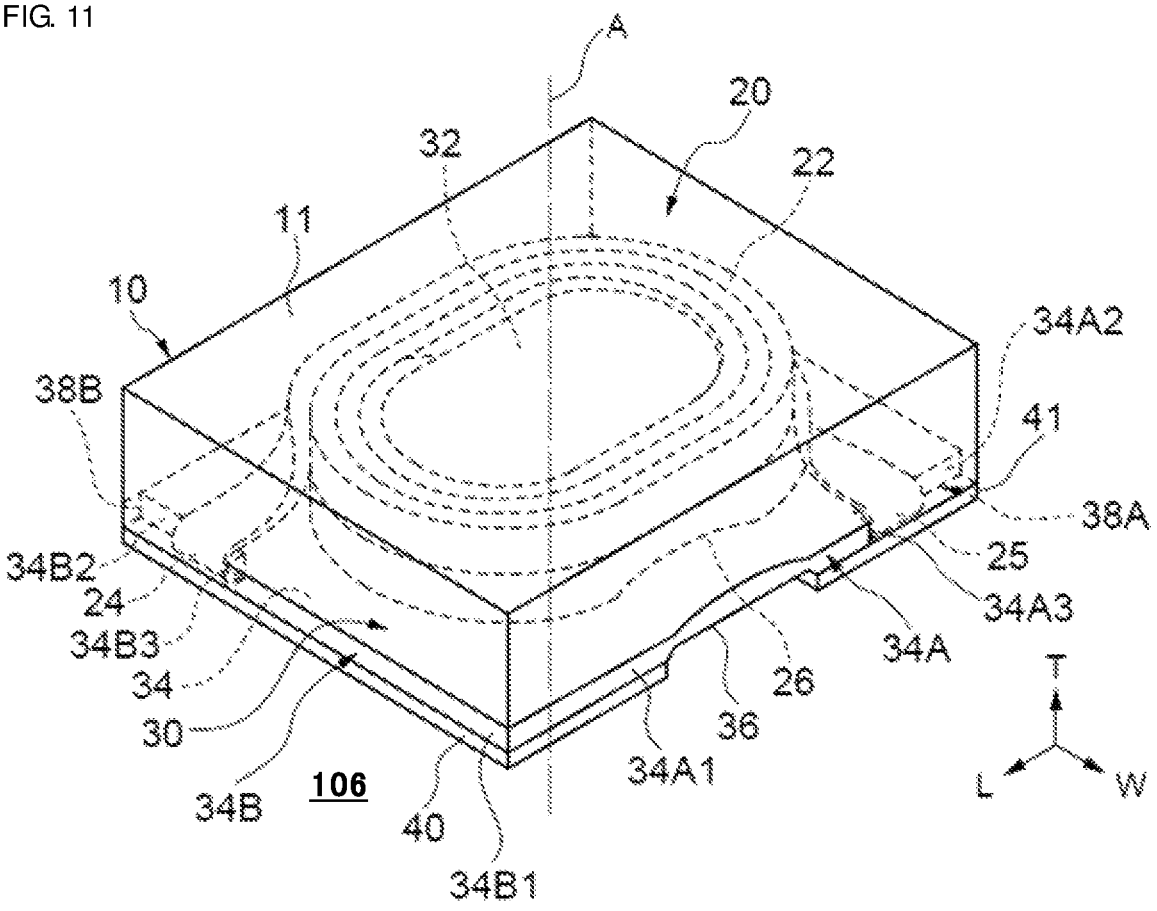
FIG. 11 is a partly transparent perspective view, as viewed from the upper surface side, showing a surface-mount inductor according to a third embodiment.

A surface-mount inductor 106 according to a third embodiment will be described with reference to FIG. 11. FIG. 11 is a schematic partly transparent perspective view, as viewed from the upper surface side, showing the surface-mount inductor 106. The surface-mount inductor 106 is configured in the same manner as the surface-mount inductor 100, except that the pair of extended portions 24 and 25 are extended toward different ridge portions of the base portion 34.

In the surface-mount inductor 106, cut portions 38A and 38B for housing the extended portions 24 and 25 of the coil 20 and allowing the extended portions 24 and 25 to extend to the lower surface side are formed on the side surface 34A of the base portion 34 of the core 30 and a side surface 34B orthogonal to the side surface 34A. Regarding the pair of extended portions 24 and 25, the extended portion 24 and the extended portion 25 are extended toward the side surface 34B of the base portion 34 and the side surface 34A of the base portion 34, respectively, and are disposed close to ridge portions, of the base portion 34, which are orthogonal to each other. At this time, the pair of extended portions 24 and 25 are each disposed such that one of the flat surface portions of the conductive wire is close to the ridge portion. In addition, at this time, the angular difference between the extended direction of the extended portion 24 and the extended direction of the extended portion 25 with the winding axis A as an origin is not less than about 90 degrees.

The pair of extended portions 24 and 25 are housed in the cut portions 38A and 38B, respectively, turn back, and extend to the mounting surface side of the base portion 34.

Since the pair of extended portions 24 and 25 are extended toward the ridge portions, of the base portion 34, which are orthogonal to each other, it is possible to change the number of turns of the wound portion 22 of the coil per ¼ turn.

Figure 12:
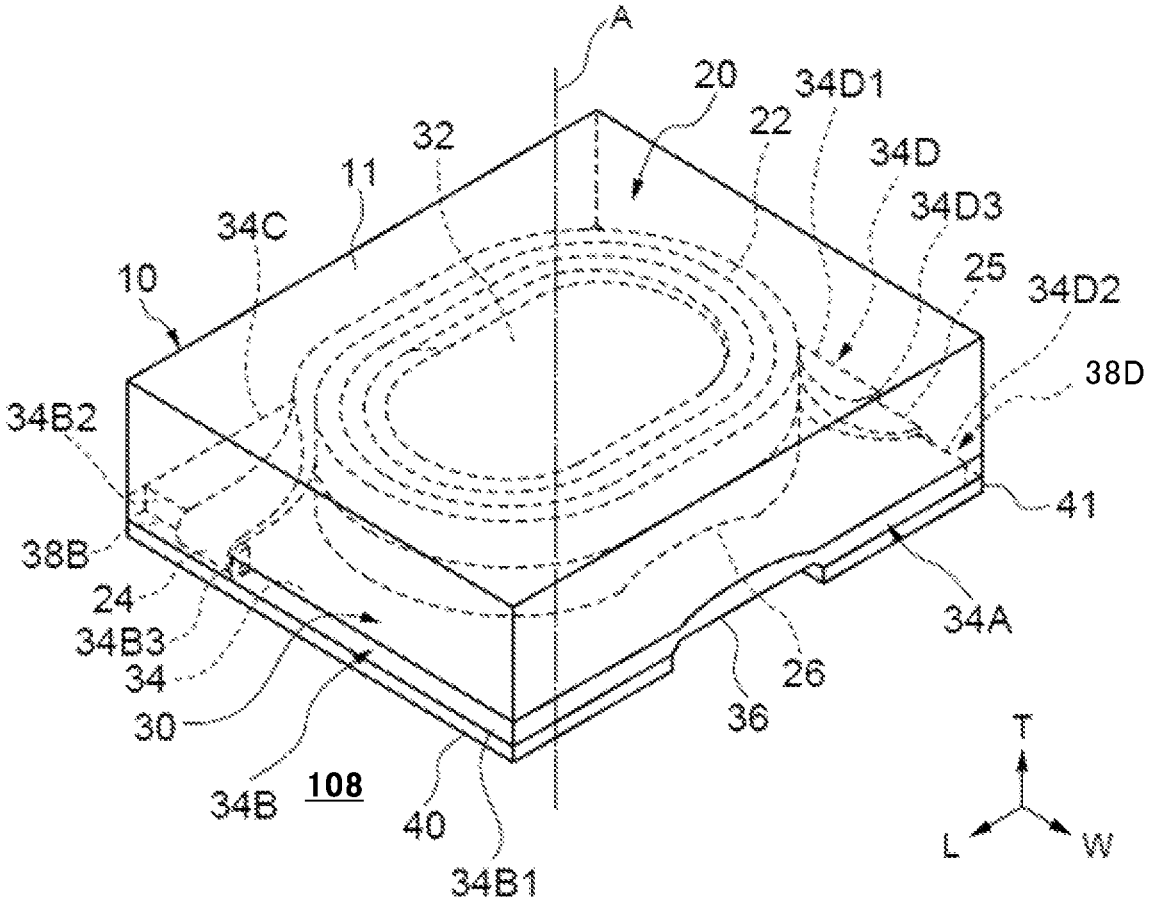
FIG. 12 is a partly transparent perspective view, as viewed from the upper surface side, showing a modification of the surface-mount inductor according to the third embodiment.

FIG. 12 is a partly transparent perspective view, as viewed from the upper surface side, showing a surface-mount inductor 108 that is a modification of the third embodiment. In the surface-mount inductor 108, cut portions 38B and 38D for housing the extended portions 24 and 25 of the coil 20 and allowing the extended portions 24 and 25 to extend to the lower surface side are formed on side surfaces 34B and 34D that are orthogonal to the opposing side surfaces 34A and 34C of the base portion 34 of the core 30 and that oppose each other. Regarding the pair of extended portions 24 and 25, the extended portion 24 and the extended portion 25 are extended toward the side surface 34B of the base portion 34 and the side surface 34D of the base portion 34, respectively, and are disposed close to ridge portions, of the base portion 34, which oppose each other. At this time, the pair of extended portions 24 and 25 are each disposed such that one of the flat surface portions of the conductive wire is close to the ridge portion. In addition, at this time, the angular difference between the extended direction of the extended portion 24 and the extended direction of the extended portion 25 with the winding axis A as an origin is not less than about 90 degrees and not greater than about 180 degrees (i.e., from about 90 degrees to about 180 degrees). The pair of extended portions 24 and 25 are housed in the cut portions 38B and 38D, respectively, turn back, and extend to the mounting surface side of the base portion 34.

Since the pair of extended portions 24 and 25 are extended toward the ridge portions, of the base portion 34, which oppose each other, it is possible to change the number of turns of the wound portion of the coil per ½ turn. In FIG. 12, the pair of extended portions 24 and 25 are extended in the length L direction of the surface-mount inductor 108, but may be extended in the width W direction.

Fourth Embodiment

Figure 13:
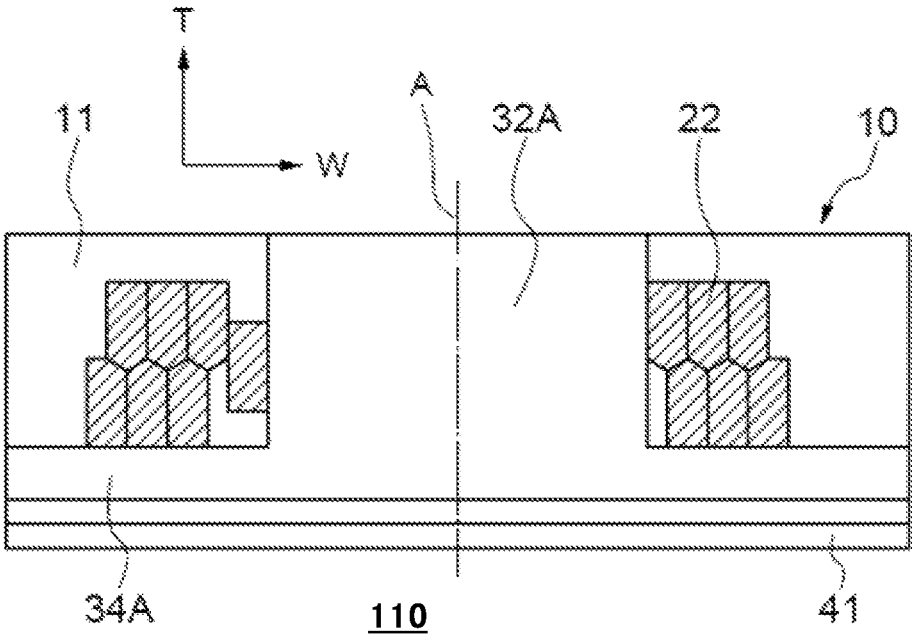
FIG. 13 is a schematic cross-sectional view of a surface-mount inductor according to a fourth embodiment.

A surface-mount inductor 110 according to a fourth embodiment will be described with reference to FIG. 13. FIG. 13 is a schematic cross-sectional view showing the surface-mount inductor 110, and is a schematic cross-sectional view taken along a plane that is orthogonal to the length L direction of the surface-mount inductor 110, that is parallel to the winding axis A of the wound portion 22 of the coil, and that longitudinally traverses a recess extending in the width W direction. The surface-mount inductor 110 is configured in the same manner as the surface-mount inductor 100, except that the end surface, of a columnar portion 32A of the core, at the side opposite to a first base portion 34A is exposed on the surface of the element assembly 10. In the surface-mount inductor 110, when the magnetic permeability of the columnar portion 32A is higher than those of the magnetic material 11 and the base portion 34, since the columnar portion 32A are extended to the upper surface of the surface-mount inductor 110, the region in which the magnetic permeability is high is increased, so that, for example, the inductance value improves.

In other words, the surface-mount inductor 110 is configured to include the element assembly 10 having a core having the columnar portion 32A and the first base portion 34A that are formed from the same composite material under the same pressing condition; a coil having the wound portion 22; and the magnetic material 11 covering the wound portion 22. The upper end surface of the columnar portion 32A is exposed from the upper surface of the surface-mount inductor 110, and the columnar portion 32A extends between the upper surface and the lower surface of the surface-mount inductor 110. The first base portion 34A is formed in a flange shape so as to be continuous from the lower end surface of the columnar portion 32A. The wound portion 22 of the coil is formed from a conductive wire wound such that the flat surface portion thereof is opposed to the columnar portion 32A, and is disposed at the upper surface side of the first base portion 34A. In the surface-mount inductor 116, the upper surface and the side surface of the wound portion 22 are covered with the magnetic material 11 having lower magnetic permeability than the core.

Figure 14:
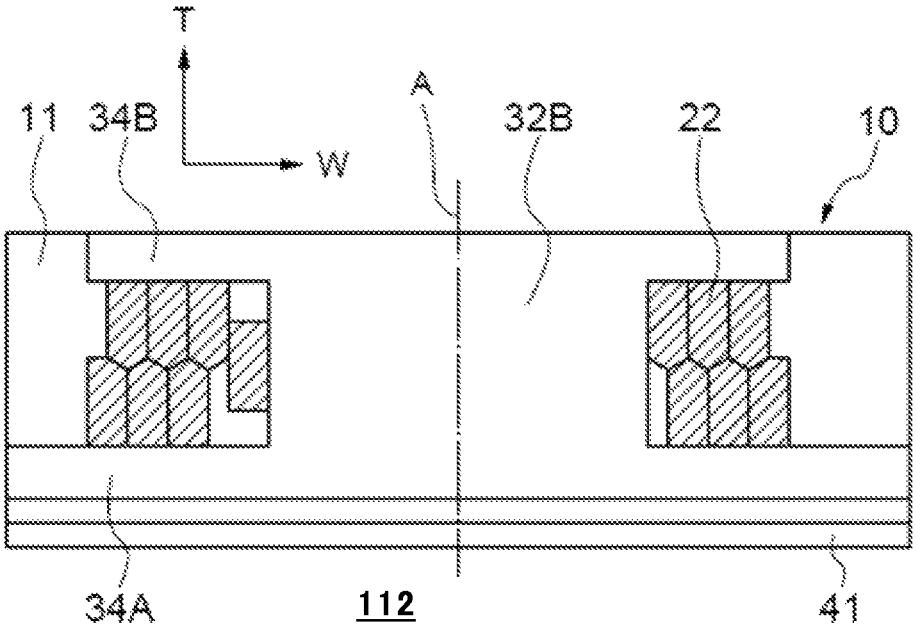
FIG. 14 is a schematic cross-sectional view of a modification of the surface-mount inductor according to the fourth embodiment.

FIG. 14 is a schematic cross-sectional view showing a surface-mount inductor 112 that is a modification of the fourth embodiment. FIG. 14 is a schematic cross-sectional view taken along a plane that is orthogonal to the length L direction of the surface-mount inductor 112, that is parallel to the winding axis A of the wound portion 22 of the coil, and that longitudinally traverses a recess extending in the width W direction. The surface-mount inductor 112 is configured in the same manner as the surface-mount inductor 100, except that the end surface, of the core, at the side opposite to the first base portion 34A of a columnar portion 32B is exposed on the surface of the element assembly 10, and the core has a second base portion 34B that has an upper surface continuous from the end surface of the columnar portion 32B, that has an area larger than that of the end surface and smaller than that of the first base portion 34A, and that is formed in a flange shape to have a thickness less than the height of the columnar portion 32B. Since the core has the second base portion 34B, the second base portion 34B serves as a guide at the upper stage side for the wound portion 22 when forming the wound portion 22, so that it is possible to more efficiently and more easily form the wound portion 22.

In other words, the surface-mount inductor 112 is configured to include the element assembly 10 having a core having the columnar portion 32B, the first base portion 34A, and the second base portion 34B that are formed from the same composite material under the same pressing condition; a coil having the wound portion 22; and the magnetic material 11 covering the wound portion 22. The upper end surface of the columnar portion 32B is exposed from the upper surface of the surface-mount inductor 112, and the columnar portion 32B extends between the upper surface and the lower surface of the surface-mount inductor 112. The first base portion 34A is formed in a flange shape so as to be continuous from the lower end surface of the columnar portion 32A. The second base portion 34B has an upper surface continuous from the upper end surface of the columnar portion 32B, has an area larger than that of the end surface of the columnar portion 32B and smaller than that of the first base portion 34A, and is formed in a flange shape to have a thickness less than the height of the columnar portion 32B. The wound portion 22 of the coil is formed from a conductive wire wound such that the flat surface portion is opposed to the columnar portion 32B, and is disposed between the upper surface of the first base portion 34A and the second base portion 34B. In the surface-mount inductor 112, the side surface of the wound portion 22 is covered with the magnetic material 11 having lower magnetic permeability than the core.

The surface-mount inductor 112 is configured such that the second base portion 34B is formed in a flat plate shape and the outermost peripheral surface of the wound portion 22 and the side surface in the thickness direction of the second base portion 34B are substantially flush with each other. Accordingly, fillability of the composite material for forming the element assembly 10 is improved. In a modification of the surface-mount inductor 112, the outermost peripheral surface of the wound portion 22 may be located inward or outward of the side surface of the second base portion 34B.

Fifth Embodiment

Figure 15:
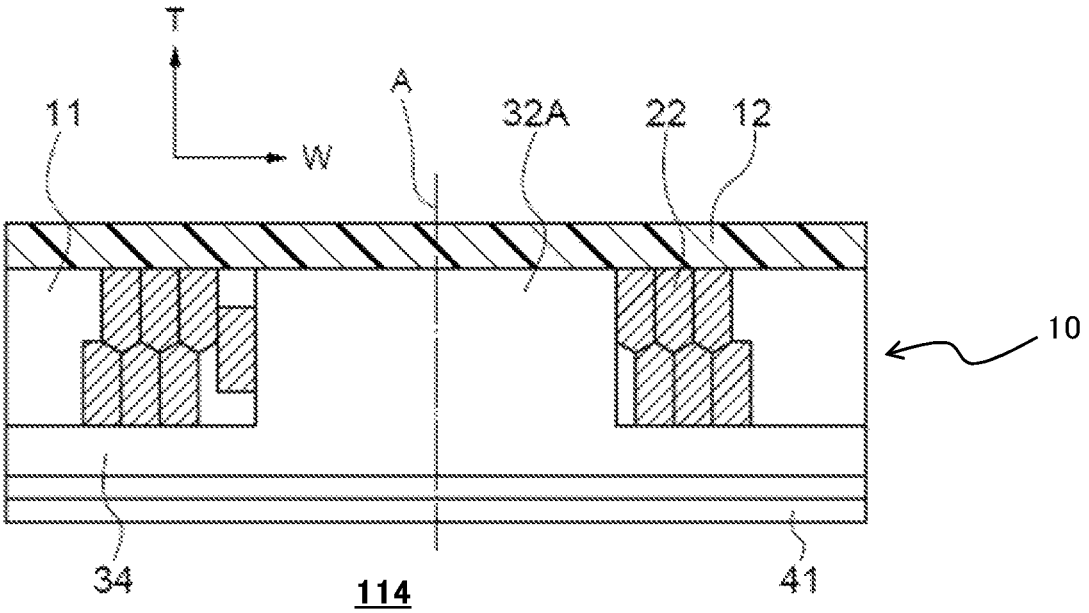
FIG. 15 is a schematic cross-sectional view of a surface-mount inductor according to a fifth embodiment.

A surface-mount inductor 114 according to a fifth embodiment will be described with reference to FIG. 15. FIG. 15 is a schematic cross-sectional view showing the surface-mount inductor 114, and is a schematic cross-sectional view taken along a plane that is orthogonal to the length L direction of the surface-mount inductor 114, that is parallel to the winding axis A of the wound portion 22 of the coil, and that longitudinally traverses a recess extending in the width W direction. The surface-mount inductor 114 is configured in the same manner as the surface-mount inductor 100, except that the end surface, of the columnar portion 32A of the core, at the side opposite to the base portion 34 is exposed on the surface of the element assembly 10, the upper surface of the wound portion 22 of the coil is exposed on the surface of the element assembly 10, and a layer 12 that covers the end surface of the columnar portion 32A, the upper surface of the wound portion 22, and the upper surface of the element assembly 10 and that does not substantially contain magnetic powder is included. Since the layer 12 that does not substantially contain magnetic powder is included, a magnetic flux generated by the coil is blocked by the layer 12 that does not substantially contain magnetic powder, that is, a so-called open magnetic circuit is formed, so that the direct current superimposition characteristics are further improved.

The layer 12 that does not substantially contain magnetic powder is formed from a resin that does not contain magnetic powder, but may contain a silica filler, an alumina filler, a non-magnetic ceramic filler, or the like instead of magnetic powder. Accordingly, the strength of the surface-mount inductor 114 is further improved. The layer 12 that does not substantially contain magnetic powder may be disposed by forming a known insulating film.

Figure 16:
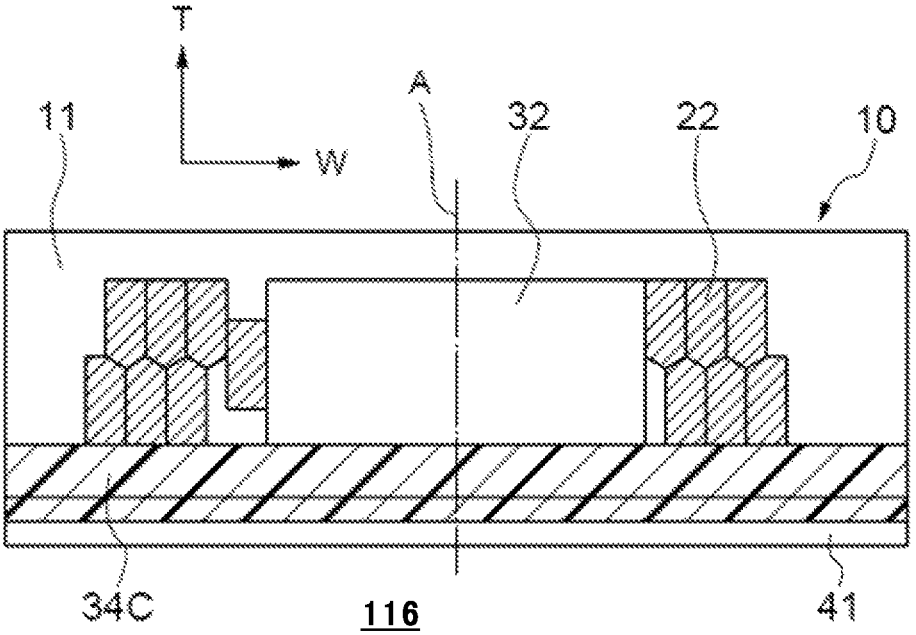
FIG. 16 is a schematic cross-sectional view of a modification of the surface-mount inductor according to the fifth embodiment.

FIG. 16 is a schematic cross-sectional view showing a surface-mount inductor 116 that is a modification of the fifth embodiment. FIG. 16 is a schematic cross-sectional view taken along a plane that is orthogonal to the length L direction of the surface-mount inductor 116, that is parallel to the winding axis A of the wound portion 22 of the coil, and that longitudinally traverses a recess extending in the width W direction. The surface-mount inductor 116 is configured in the same manner as the surface-mount inductor 100, except that a base portion 34C does not substantially contain magnetic powder. Since the base portion 34C that does not substantially contain magnetic powder is included, a magnetic flux generated by the coil is blocked by the base portion 34C that does not substantially contain magnetic powder, that is, a so-called field path structure is formed, so that the direct current superposition characteristics are further improved.

The base portion 34C is formed from a resin that does not contain magnetic powder, but may contain a silica filler, an alumina filler, a non-magnetic ceramic filler, or the like instead of magnetic powder. Accordingly, the strength of the surface-mount inductor 116 is further improved. In FIG. 16, the entirety of the base portion 34C does not substantially contain magnetic powder, but the base portion 34C may be formed such that a partial region of the base portion 34C does not substantially contain magnetic powder and the other region contains magnetic powder, for example, by forming a region that penetrates the lower end surface of the columnar portion 32 and the base portion 34C, that has an area equal to, smaller than, or larger than that of the lower end surface of the columnar portion 32, and that does not substantially contain magnetic powder, by forming a region that does not substantially contain magnetic powder, in an upper portion of the base portion 34C, or by forming a region that does not substantially contain magnetic powder, in a lower portion of the base portion 34C.

The core including the base portion 34C is produced, for example, as described below. A composite material containing magnetic powder and a resin is loaded into a second portion of a cavity of a mold that includes the cavity having a first portion capable of forming a columnar portion and a flat plate-shaped base portion and having a shape and a depth for forming the base portion and the second portion provided on the bottom surface of the first portion and having a shape and a depth for forming the columnar portion, as shown in FIGS. 5A and 5B. Next, a non-magnetic composite material containing a resin and a filler such as a silica filler, an alumina filler, and a non-magnetic ceramic filler is loaded into the first portion of the cavity of the mold. Then, molding is performed using the mold. Accordingly, a core having a base portion in which a region that does not contain magnetic powder is formed and a columnar portion that contains the magnetic powder and the resin and that is integrally formed with the base portion, is produced.

Figure 17:
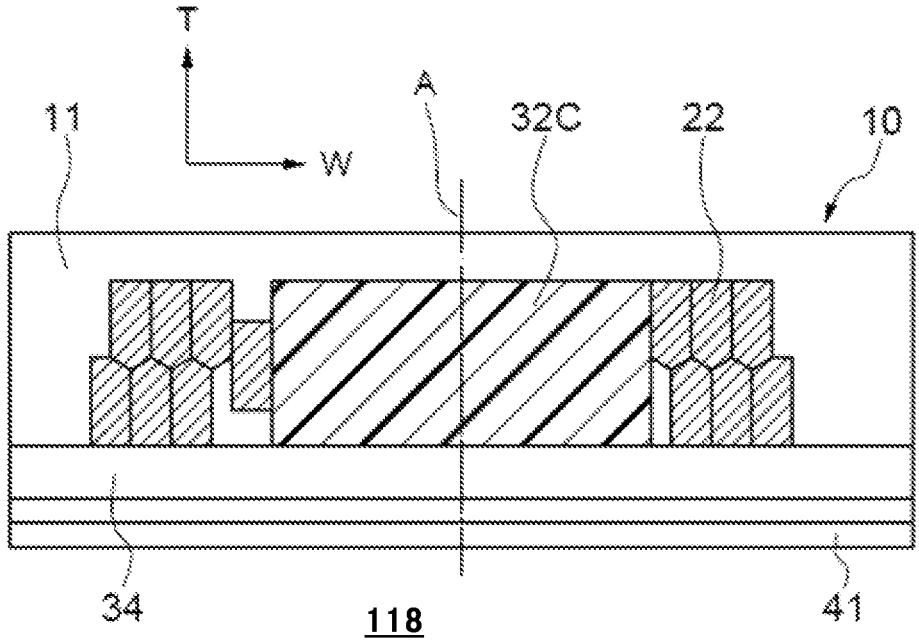
FIG. 17 is a schematic cross-sectional view of a modification of the surface-mount inductor according to the fifth embodiment.

FIG. 17 is a schematic cross-sectional view showing a surface-mount inductor 118 that is a modification of the fifth embodiment. FIG. 17 is a schematic cross-sectional view taken along a plane that is orthogonal to the length L direction of the surface-mount inductor 118, that is parallel to the winding axis A of the wound portion 22 of the coil, and that longitudinally traverses a recess extending in the width W direction. The surface-mount inductor 118 is configured in the same manner as the surface-mount inductor 100, except that a columnar portion 32C does not substantially contain magnetic powder. Since the columnar portion 32C that does not substantially contain magnetic powder is included, a magnetic flux generated by the coil is blocked by the columnar portion 32C that does not substantially contain magnetic powder, that is, a so-called field path structure is formed, so that the direct current superposition characteristics are further improved.

The columnar portion 32C is formed from a resin that does not contain magnetic powder, but may contain a silica filler, an alumina filler, a non-magnetic ceramic filler, or the like instead of magnetic powder. Accordingly, the strength of the surface-mount inductor 118 is further improved. In FIG. 17, the entirety of the columnar portion 32C does not substantially contain magnetic powder, but the columnar portion 32C may be formed such that a partial region of the columnar portion 32C does not substantially contain magnetic powder and the other region contains magnetic powder, by forming a region that extends in a direction orthogonal to the winding axis A of the wound portion 22 of the coil and that does not substantially contain magnetic powder.

The core including the columnar portion 32C is produced, for example, as described below. A non-magnetic composite material containing a resin and a filler such as a silica filler, an alumina filler, and a non-magnetic ceramic filler is loaded into a second portion of a cavity of a mold that includes the cavity having a first portion capable of forming a columnar portion and a flat plate-shaped base portion and having a shape and a depth for forming the base portion and the second portion provided on the bottom surface of the first portion and having a shape and a depth for forming the columnar portion, as shown in FIGS. 5A and 5B. Next, a composite material containing magnetic powder and a resin and a filler is loaded into the first portion within the cavity of the mold. Then, molding is performed using the mold. Accordingly, a core having a columnar portion in which a region that does not contain magnetic powder is formed and a base portion that contains magnetic powder and that is integrally formed with the columnar portion, is produced.

Sixth Embodiment

Figure 18:
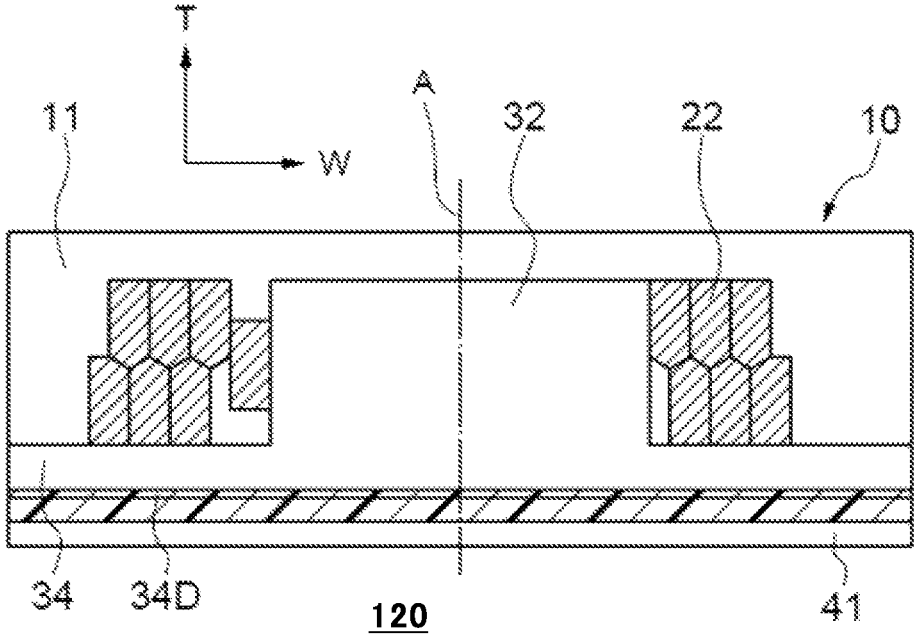
FIG. 18 is a schematic cross-sectional view at the upper surface side showing a surface-mount inductor according to a sixth embodiment.

A surface-mount inductor 120 according to a sixth embodiment will be described with reference to FIG. 18. FIG. 18 is a schematic cross-sectional view showing the surface-mount inductor 120, and is a schematic cross-sectional view taken along a plane that is orthogonal to the length L direction of the surface-mount inductor 120, that is parallel to the winding axis A of the wound portion 22 of the coil, and that longitudinally traverses a recess extending in the width W direction. The surface-mount inductor 120 is configured in the same manner as the surface-mount inductor 100, except that the magnetic powder contained in the core includes metallic magnetic powder; and in a partial region at the mounting surface side of the base portion 34 of the core, a high-insulation region 34D in which the content of the metallic magnetic powder is less than that in the other region of the base portion 34 or in which no metallic magnetic powder is contained is formed. Since the high-insulation region 34D is provided at the mounting surface side of the base portion 34, it is possible to further improve a dielectric breakdown voltage between the wound portion 22 and the external terminals 40 and 41 disposed at the mounting surface side.

In the core in which the content of the metallic magnetic powder in the high-insulation region 34D is low, for example, the high-insulation region 34D is formed by increasing the content of a resin. In addition, in the case of the core in which the content of the metallic magnetic powder in the high-insulation region 34D is low, a filler having insulation properties may be contained. Furthermore, in the core in which the high-insulation region 34D contains no metallic magnetic powder, for example, the high-insulation region 34D is formed from an insulating material composed of only a resin, or an insulating material containing a resin and a filler having insulation properties such as a silica filler and a ferrite filler instead of the metallic magnetic powder.

The core including the high-insulation region 34D is s produced, for example, as described below. A metallic magnetic material containing metallic magnetic powder and a resin is loaded into a second portion and the bottom surface side of a first portion within a cavity of a mold that includes the cavity having the first portion capable of forming a columnar portion and a flat plate-shaped base portion and having a shape and a depth for forming the base portion and the second portion provided on the bottom surface of the first portion and having a shape and a depth for forming the columnar portion, as shown in FIGS. 5A and 5B. Next, a metallic magnetic material having an increased content ratio of a resin, an insulating material composed of only a resin, or an insulating material containing a resin and a filler having insulation properties such as a silica filler and a ferrite filler instead of the metallic magnetic powder, is loaded into the upper surface side of the first portion within the cavity of the mold. Then, molding is performed using the mold. Accordingly, a core having a base portion in which a high-insulation region is formed at the mounting surface side and a columnar portion that contains the metallic magnetic powder and the resin and that is integrally formed with the base portion, is produced.

Figure 19:
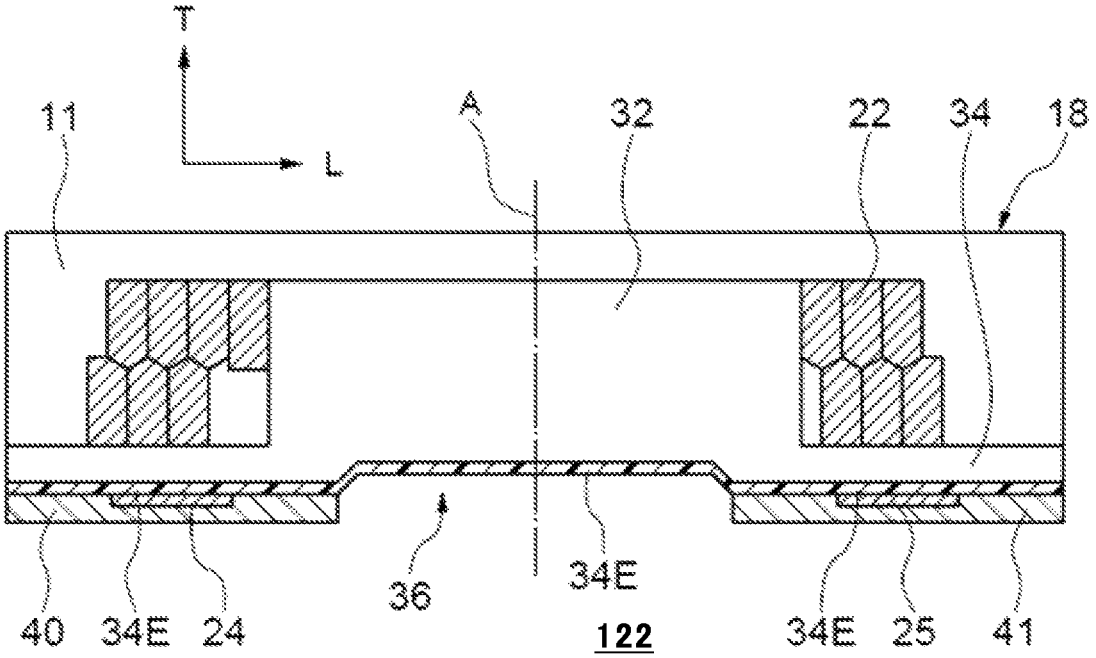
FIG. 19 is a schematic cross-sectional view of a modification of the surface-mount inductor according to the sixth embodiment.

FIG. 19 is a schematic cross-sectional view showing a surface-mount inductor 122 that is a modification of the sixth embodiment. FIG. 19 is a schematic cross-sectional view taken along a plane that is orthogonal to the width W direction of the surface-mount inductor 122, that is parallel to the winding axis A of the wound portion 22 of the coil, and that laterally traverses a recess extending in the width W direction. The surface-mount inductor 122 is configured in the same manner as the surface-mount inductor 100, except that the magnetic powder contained in the core includes metallic magnetic powder and a high-insulation region 34E is formed by disposing an insulating film at the mounting surface side of the base portion 34 of the core. Since the high-insulation region is formed by the insulating film, it is possible to easily and efficiently form a high-insulation region at the mounting surface side of the base portion 34 of the core.

Figure 20:
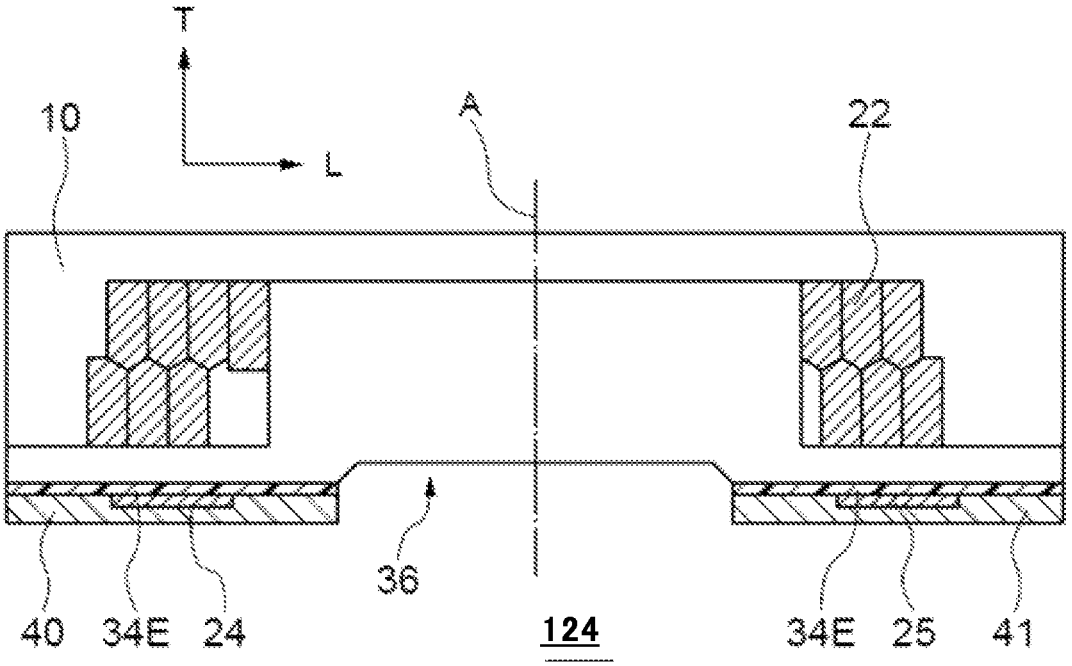
FIG. 20 is a schematic cross-sectional view of a modification of the surface-mount inductor according to the sixth embodiment.

FIG. 20 is a schematic cross-sectional view showing a surface-mount inductor 124 that is a modification of the sixth embodiment. FIG. 20 is a schematic cross-sectional view taken along a plane that is orthogonal to the width W direction of the surface-mount inductor 124, that is parallel to the winding axis A of the wound portion 22 of the coil, and that laterally traverses a recess extending in the width W direction. The surface-mount inductor 124 is configured in the same manner as the surface-mount inductor 100, except that the magnetic powder contained in the core includes metallic magnetic powder and a high-insulation region 34E is formed by disposing an insulating film at the mounting surface side of the base portion 34 of the core in the region in which the external terminals 40 and 41 are formed. Since the high-insulation region is formed by the insulating film, it is possible to easily and efficiently form a high-insulation region at the mounting surface side of the base portion 34 of the core. In addition, it is possible to make the area of the high-insulation region to be formed smaller, and thus the productivity improves.

In the surface-mount inductor 124, the pair of extended portions 24 and 25 extending at the mounting surface side are disposed on the high-insulation region 34E and separated from the base portion 34 of the core containing the metallic magnetic powder. The external terminals 40 and 41 are formed on the pair of extended portions 24 and 25 extending at the mounting surface side, for example, by plating.

Seventh Embodiment

Figure 21:
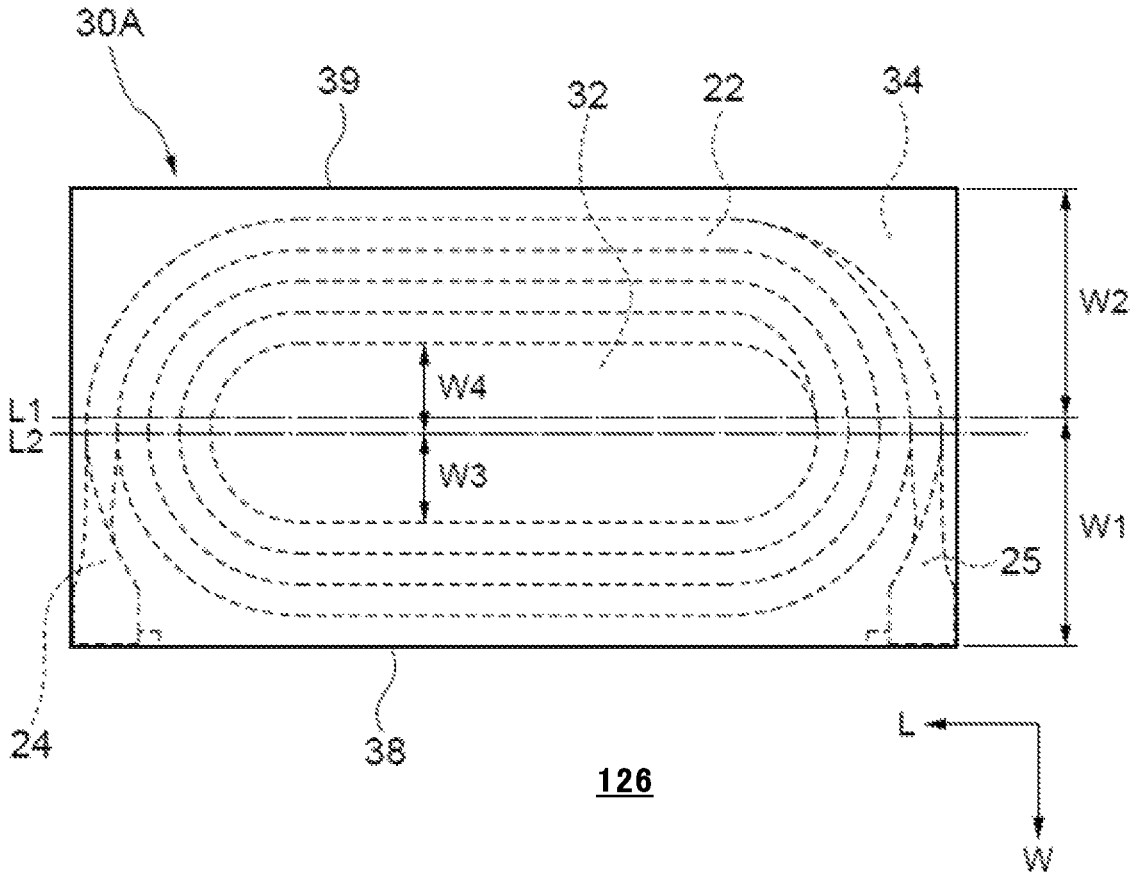
FIG. 21 is a partly transparent plan view, as viewed from the upper surface side, showing a surface-mount inductor according to a seventh embodiment.

A surface-mount inductor 126 according to a seventh embodiment will be described with reference to FIG. 21. FIG. 21 is a schematic partly transparent plan view, as viewed from the upper surface side, showing the surface-mount inductor 126. The surface-mount inductor 126 is configured in the same manner as the surface-mount inductor 100, except that the columnar portion 32 of a core 30A is disposed closer to a first linear portion 38 at the side at which the pair of extended portions 24 and 25 are extended, than to a second linear portion 39 opposing the first linear portion 38. Since the columnar portion 32 of the core 30A is unevenly disposed at the linear portion side at which the pair of extended portions 24 and 25 are extended, the magnetic flux balance in the element assembly becomes better.

In the wound portion 22 of the coil of the surface-mount inductor 126, the number of turns at the side that is closer to the second linear portion 39 and that is the side opposite to the first linear portion 38 of the base portion 34 at which the pair of extended portions 24 and 25 are extended, is larger than the number of turns at the side closer to the first linear portion 38, by one.

In addition, in the surface-mount inductor 126, the columnar portion 32 is disposed such that a straight line L2 to which distances W3 and W4 from both side surfaces of the columnar portion 32 orthogonal to the width W direction of the surface-mount inductor 126 are equal to each other and that passes through the center of the columnar portion 32 is closer to the first linear portion 38 by at least a distance equal to the thickness of the conductive wire that forms the coil, than a straight line L1 to which distances W1 and W2 from the first linear portion 38 and the second linear portion 39 of the base portion 34 of the core are equal to each other and that passes through the center of the base portion 34. Accordingly, the wound portion 22 is disposed such that the shortest distances between the outer peripheral portion of the wound portion 22 and the first linear portion 38 and the second linear portion 39 are substantially equal to each other, and the balance of a magnetic flux in the surface-mount inductor 126 becomes good. In addition, the outer peripheral portion of the wound portion 22 is inhibited from being exposed from the side surface of the element assembly.

Eighth Embodiment

Figure 22:
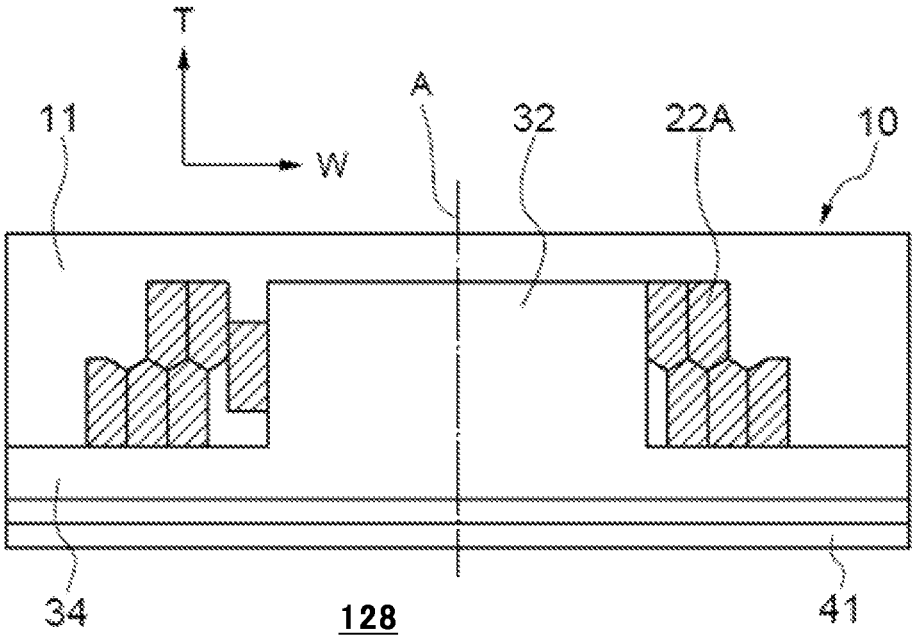
FIG. 22 is a schematic cross-sectional view of a surface-mount inductor according to an eighth embodiment.

A surface-mount inductor 128 according to an eighth embodiment will be described with reference to FIG. 22. FIG. 22 is a schematic cross-sectional view showing the surface-mount inductor 128. FIG. 22 is a schematic cross-sectional view taken along a cross-section that is orthogonal to the length L direction of the surface-mount inductor 128, that is parallel to the winding axis A of the wound portion 22 of the coil, and that longitudinally traverses a recess extending in the width W direction. The surface-mount inductor 128 is configured in the same manner as the surface-mount inductor 100, except that the number of turns at the upper stage side and the number of turns at the lower stage side of a wound portion 22A of the coil wound in two upper and lower stages are different from each other.

In the surface-mount inductor 128, the side of the coil at which the number of turns is larger is disposed in contact with the base portion 34 of the core. That is, the number of turns at the lower stage side is larger than the number of turns at the upper stage side. Since the number of turns at the upper stage side is smaller, when forming the element assembly 10, the composite material is able to sufficiently flow around, and the fillability of the composite material improves, so that better magnetic characteristics are obtained.

Figure 23:
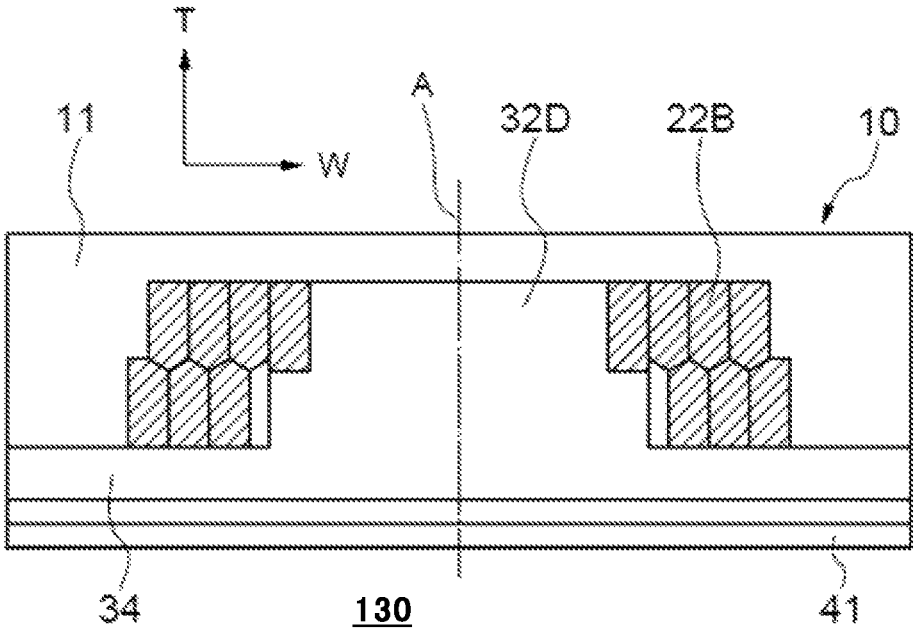
FIG. 23 is a schematic cross-sectional view of a modification of the surface-mount inductor according to the eighth embodiment.

FIG. 23 is a schematic cross-sectional view showing a surface-mount inductor 130 that is a modification of the tenth embodiment. FIG. 23 is a schematic cross-sectional view taken along a cross-section that is orthogonal to the length L direction of the surface-mount inductor 130, that is parallel to the winding axis A of the wound portion 22 of the coil, and that longitudinally traverses a recess extending in the width W direction. The surface-mount inductor 130 is configured in the same manner as the surface-mount inductor 100, except that a columnar portion 32D of the core is formed in two stages having different outer diameters and the number of turns at the upper stage side and the number of turns at the lower stage side of a wound portion 22B of the coil wound in two upper and lower stages are different from each other.

In the surface-mount inductor 130, since the columnar portion 32D is formed such that the outer diameter of the columnar portion 32D at the side closer to the base portion 34 of the core is larger, the strength of the core improves, so that it is possible to more stably wind the conductive wire.

Ninth Embodiment

Figure 24:
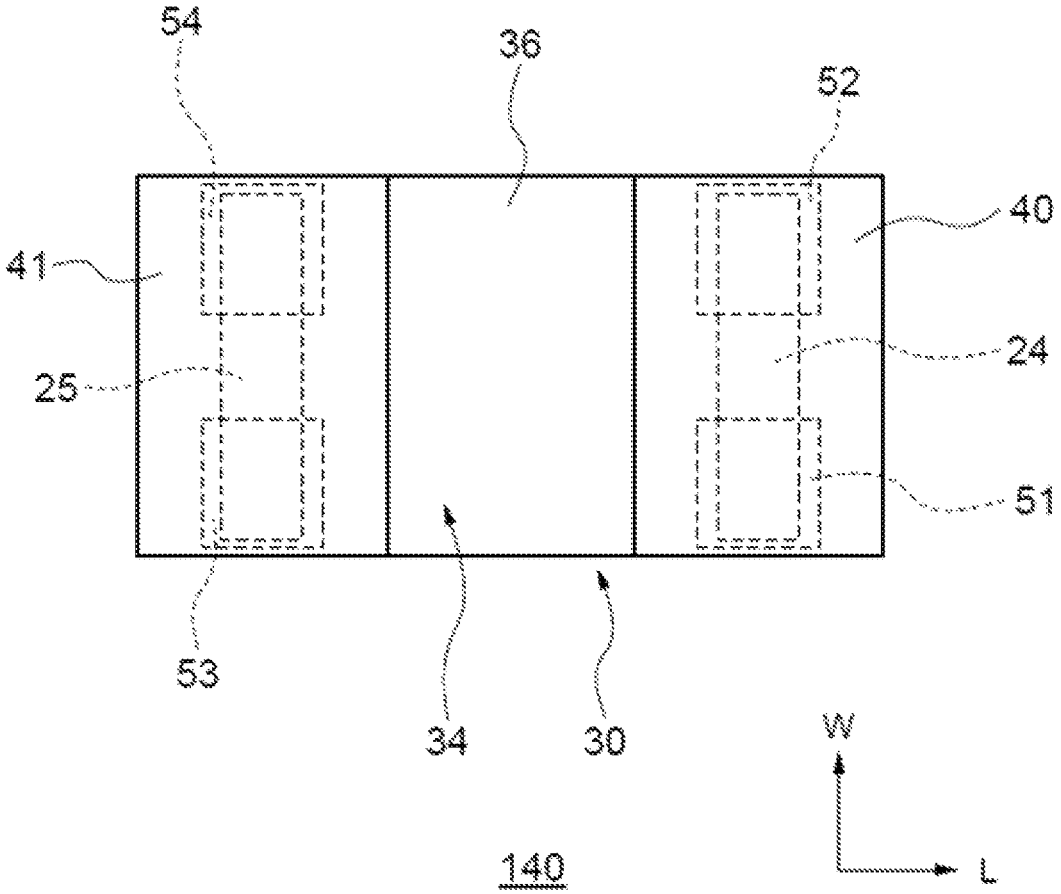
FIG. 24 is a partly transparent plan view, as viewed from the mounting surface side, of a surface-mount inductor according to a ninth embodiment.

A surface-mount inductor 140 according to a ninth embodiment will be described with reference to FIG. 24. FIG. 24 is a partly transparent plan view of the surface-mount inductor 140 as viewed from the mounting surface side. The surface-mount inductor 140 is configured in the same manner as the surface-mount inductor 100, except that, on the bottom surface of the base portion 34 of the core 30, a first electrode covering a root portion of the extended portion 24 that is turned back from the upper surface of the base portion 34, a second electrode covering an end portion of the extended portion 24, a third electrode covering a root portion of the extended portion 25 that is turned back from the upper surface of the base portion 34, and a fourth electrode covering an end portion of the extended portion 25 are formed, and an external terminal 40 covering the extended portion 24, the first electrode, and the second electrode and an external terminal 41 covering the extended portion 25, the third electrode, and the fourth electrode are formed. Each of the first to fourth electrodes is formed, for example, from a resin containing metallic particles such as silver powder. Accordingly, each external terminal is connected to the electrodes and the extended portion. In this case, the external terminals 40 and 41 may be formed by peeling off the exterior resin on a portion of the mounting surface of the element assembly on which each external terminal is to be formed, applying a resin containing metallic particles onto the extended portions 24 and 25 to form electrodes, and causing plating growth on these.

In the above embodiments, the shape of the upper surface of the base portion is substantially a rectangle having a cut portion, but may be substantially a square, a circle, an oval, an ellipse, a polygon, or the like.

The wound portion of the coil may be formed such that the winding direction thereof is counterclockwise as viewed from the upper surface side.

In the first to ninth embodiments, the upper stage and the lower stage of the coil may be turned upside down and disposed on the base portion of the core.

In the first to eighth embodiments, as shown in FIG. 24, the pair of extended portions 24 and 25 may be disposed on regions of the bottom surface of the base portion 34 of the core 30 at both sides of the recess 36, a first electrode covering a root portion of the extended portion 24 that is turned back from the upper surface of the base portion 34, a second electrode covering an end portion of the extended portion 24, a third electrode covering a root portion of the extended portion 25 that is turned back from the upper surface of the base portion 34, and a fourth electrode covering an end portion of the extended portion 25 may be formed, on the bottom surface of the base portion 34 of the core 30, and an external terminal 40 covering the first electrode and the second electrode of the extended portion 24, and an external terminal 41 covering the third electrode and the fourth electrode of the extended portion 25 may be formed on the bottom surface of the base portion 34 of the core 30.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A surface-mount inductor comprising:

an element assembly including a magnetic body containing magnetic powder, a core containing magnetic powder in at least a partial region, and a coil including a conductive wire having an insulating coating and having a pair of flat surface portions opposing each other; and a pair of external terminals provided on the element assembly, wherein the magnetic body covers at least a part of the core and the coil, the core includes a base portion having a lower surface that is a mounting surface, an upper surface at a side opposite to the mounting surface, and side surfaces adjacent to the upper surface and the lower surface, and a columnar portion disposed on the upper surface of the base portion, the coil is disposed on the base portion, and the coil includes:

a wound portion formed by winding the conductive wire on the columnar portion in upper and lower two stages such that the flat surface portion of the conductive wire is in contact with the columnar portion and the flat surface portions oppose each other, wherein both ends of the wound portion are located at an outer peripheral portion of the wound portion and the two stages of the conductive wire are connected to each other at an inner peripheral portion of the wound portion, and a pair of extended portions extended from the wound portion toward the side surface of the base portion, the pair of external terminals are disposed on the mounting surface of the element assembly and connected to the pair of extended portions, respectively, the base portion has at least one ridge portion at which the upper surface and the side surface are in linear contact with each other, the pair of extended portions are each disposed such that the flat surface portion connected to the flat surface portion disposed at an inner side portion of the conductive wire located at the outer peripheral portion of the wound portion is close to the ridge portion, the pair of extended portions are extended toward the same side surface of the base portion and disposed close to the ridge portion, and a distance between positions at which the extended portions are in contact with the ridge portion is smaller than a distance between positions at which the wound portion is connected to the extended portions.

2. The surface-mount inductor according to claim 1, wherein the base portion has a plurality of ridge portions at which the upper surface and the side surfaces are in linear contact with each other, and each of the pair of extended portions are disposed close to different ridge portions.

3. The surface-mount inductor according to claim 1, wherein the core is disposed such that the lower surface of the base portion and an end surface of the columnar portion at a side opposite to the base portion are exposed from the element assembly.

4. The surface-mount inductor according to claim 1, wherein the base portion has a region that does not contain magnetic powder.

5. The surface-mount inductor according to claim 1, wherein the columnar portion has a region that does not contain magnetic powder.

6. The surface-mount inductor according to claim 1, wherein the magnetic powder of the core includes metallic magnetic powder, and a high-insulation region located at the mounting surface of the base portion has higher insulation properties than other surfaces.

7. The surface-mount inductor according to claim 1, wherein the two stages of the wound portion have different numbers of turns, and the stage closer to the base portion has a larger number of turns.

8. The surface-mount inductor according to claim 1, wherein the base portion has another ridge portion opposing the ridge portion, and the columnar portion is disposed closer to the ridge portion than to said another ridge portion.

9. The surface-mount inductor according to claim 2, wherein the core is disposed such that the lower surface of the base portion and an end surface of the columnar portion at a side opposite to the base portion are exposed from the element assembly.

10. The surface-mount inductor according to claim 1, wherein the wound portion is disposed such that a surface of the wound portion at the side opposite to the mounting surface is exposed from the element assembly, and a layer that does not contain magnetic powder is provided on the surface of the wound portion at the opposite side.

11. A surface-mount inductor comprising:

an element assembly including a magnetic body containing magnetic powder, a core containing magnetic powder in at least a partial region, and a coil including a conductive wire having an insulating coating and having a pair of flat surface portions opposing each other; and a pair of external terminals provided on the element assembly, wherein the magnetic body covers at least a part of the core and the coil, the core includes a base portion having a lower surface that is a mounting surface, an upper surface at a side opposite to the mounting surface, and side surfaces adjacent to the upper surface and the lower surface, and a columnar portion disposed on the upper surface of the base portion, the coil is disposed on the base portion, and the coil includes:

a wound portion formed by winding the conductive wire on the columnar portion in upper and lower two stages such that the flat surface portion of the conductive wire is in contact with the columnar portion and the flat surface portions oppose each other, wherein both ends of the wound portion are located at an outer peripheral portion of the wound portion and the two stages of the conductive wire are connected to each other at an inner peripheral portion of the wound portion, and a pair of extended portions extended from the wound portion toward the side surface of the base portion, the pair of external terminals are disposed on the mounting surface of the element assembly and connected to the pair of extended portions, respectively, the base portion has at least one ridge portion at which the upper surface and the side surface are in linear contact with each other, the pair of extended portions are each disposed such that the flat surface portion connected to the flat surface portion disposed at an inner side portion of the conductive wire located at the outer peripheral portion of the wound portion is close to the ridge portion, the pair of extended portions are extended toward the same side surface of the base portion and disposed close to the ridge portion, and the base portion has another ridge portion opposing the ridge portion, and the columnar portion is disposed closer to the ridge portion than to said another ridge portion.

12. The surface-mount inductor according to claim 11, wherein the core is disposed such that the lower surface of the base portion and an end surface of the columnar portion at a side opposite to the base portion are exposed from the element assembly.

13. The surface-mount inductor according to claim 11, wherein the base portion has a region that does not contain magnetic powder.

14. The surface-mount inductor according to claim 11, wherein the columnar portion has a region that does not contain magnetic powder.

15. The surface-mount inductor according to claim 11, wherein the magnetic powder of the core includes metallic magnetic powder, and a high-insulation region located at the mounting surface of the base portion has higher insulation properties than other surfaces.

16. The surface-mount inductor according to claim 11, wherein the two stages of the wound portion have different numbers of turns, and the stage closer to the base portion has a larger number of turns.

17. A surface-mount inductor comprising:

an element assembly including a magnetic body containing magnetic powder, a core containing magnetic powder in at least a partial region, and a coil including a conductive wire having an insulating coating and having a pair of flat surface portions opposing each other; and a pair of external terminals provided on the element assembly, wherein the magnetic body covers at least a part of the core and the coil, the core includes a base portion having a lower surface that is a mounting surface, an upper surface at a side opposite to the mounting surface, and side surfaces adjacent to the upper surface and the lower surface, and a columnar portion disposed on the upper surface of the base portion, the coil is disposed on the base portion, and the coil includes:

a wound portion formed by winding the conductive wire on the columnar portion in upper and lower two stages such that the flat surface portion of the conductive wire is in contact with the columnar portion and the flat surface portions oppose each other, wherein both ends of the wound portion are located at an outer peripheral portion of the wound portion and the two stages of the conductive wire are connected to each other at an inner peripheral portion of the wound portion, and a pair of extended portions extended from the wound portion toward the side surface of the base portion, the pair of external terminals are disposed on the mounting surface of the element assembly and connected to the pair of extended portions, respectively, the base portion has at least one ridge portion at which the upper surface and the side surface are in linear contact with each other, the pair of extended portions are each disposed such that the flat surface portion connected to the flat surface portion disposed at an inner side portion of the conductive wire located at the outer peripheral portion of the wound portion is close to the ridge portion, the wound portion is disposed such that a surface of the wound portion at the side opposite to the mounting surface is exposed from the element assembly, and a layer that does not contain magnetic powder is provided on the surface of the wound portion at the opposite side.

* * * * *